US012583650B2

(12) United States Patent
Swain et al.

(10) Patent No.: US 12,583,650 B2
(45) Date of Patent: Mar. 24, 2026

(54) CONTAINER AND LID WITH PROTECTIVE SEAL

(71) Applicant: RBA Enterprises, LLC, Sherman Oaks, CA (US)

(72) Inventors: Brennan Carl Swain, Marina del Rey, CA (US); Robert Christopher Frisbee, Sherman Oaks, CA (US)

(73) Assignee: RBA Enterprises, LLC, Sherman Oaks, CA (US)

( * ) Notice: Subject to any disclaimer, the term of this patent is extended or adjusted under 35 U.S.C. 154(b) by 612 days.

(21) Appl. No.: 17/297,087

(22) PCT Filed: Apr. 26, 2021

(86) PCT No.: PCT/US2021/029128
§ 371 (c)(1),
(2) Date: May 26, 2021

(87) PCT Pub. No.: WO2021/217125
PCT Pub. Date: Oct. 28, 2021

(65) Prior Publication Data

US 2023/0348150 A1 Nov. 2, 2023

Related U.S. Application Data

(60) Provisional application No. 63/015,244, filed on Apr. 24, 2020.

(51) Int. Cl.
*B65D 41/62* (2006.01)
*B65D 53/08* (2006.01)

(52) U.S. Cl.
CPC ..... *B65D 41/62* (2013.01); *B65D 53/08* (2013.01)

(58) Field of Classification Search
CPC ..... A47G 19/2211; A47G 19/2216; B65D 51/18; B65D 2251/0003; B65D 41/62; B65D 53/08; B65D 41/34; B65D 41/3495; B65D 41/349
See application file for complete search history.

(56) References Cited

U.S. PATENT DOCUMENTS 4,331,255 A * 5/1982 Fournier ..... B65D 51/18 220/270
4,940,158 A * 7/1990 Farrell ..... B65D 81/3453 220/276
5,147,054 A * 9/1992 Pehr ..... B65D 51/20 215/253
5,273,176 A * 12/1993 Diaz ..... B65D 51/20 220/276
5,765,716 A * 6/1998 Cai ..... A47G 23/0216 220/738
5,971,195 A * 10/1999 Reidinger ..... B65D 51/28 D9/434
8,695,842 B2 * 4/2014 Gonzalez Sanchez ..... B65D 51/007 215/253

(Continued)

*Primary Examiner* — Kareen K Thomas
(74) *Attorney, Agent, or Firm* — Jeffer Mangels & Mitchell LLP; Brennan C. Swain, Esq.

(57) ABSTRACT

A container and lid assembly that includes a container a lid, and a seal assembly that includes a lip cover, a lid cover, and a connection member extending between the lip cover and the lid cover. The container includes at least one sidewall, a bottom, a lip and an open top. The lip cover is secured on the container, and the lid cover is secured on the lid.

25 Claims, 28 Drawing Sheets

(56) References Cited

U.S. PATENT DOCUMENTS

| | | | | |
|---|---|---|---|---|
| 9,078,535 | B1 * | 7/2015 | Buck | B65D 43/169 |
| 2004/0118847 | A1 * | 6/2004 | Giraud | B65D 43/0208 220/254.3 |
| 2010/0320205 | A1 * | 12/2010 | Aranda Campin | B65D 51/185 220/254.1 |
| 2013/0270275 | A1 * | 10/2013 | Abrams | B65D 51/00 220/359.1 |
| 2013/0306663 | A1 * | 11/2013 | Stuchell | B65D 43/0212 220/711 |

* cited by examiner

CONTAINER AND LID WITH PROTECTIVE SEAL

CROSS REFERENCE TO RELATED APPLICATIONS

This application is a national stage application, filed under 35 U.S.C. § 371, of International Patent Application No. PCT/US21/29128 filed Apr. 26, 2021, which claims the benefit of U.S. Provisional Patent Application No. 63/015,244, filed Apr. 24, 2020, the entireties of which are incorporated herein by reference.

BACKGROUND OF THE INVENTION

At establishments such as fast food restaurants, convenience stores and coffee houses, disposable soft drink and hot liquid cups are typically stored in a stacked manner where they are nested within one another. These types of cups are often used with lids, which are usually dispensed separately. The cups and lids are often touched and handled by other customers or employees, which can spread germs and diseases or otherwise dirty or compromise the cups and/or lids.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention there is provided a container and lid assembly that includes a container a lid, and a seal assembly that includes a lip cover, a lid cover, and a connection member extending between the lip cover and the lid cover. The container includes at least one sidewall, a bottom, a lip and an open top. The lip cover is secured on the container, and the lid cover is secured on the lid. In a preferred embodiment, the lip cover extends around the lip and defines a central opening and the lip cover includes a tab that is configured to be pulled to remove the lip cover from the cup. At least a first weakened section may be formed in the lip cover adjacent to the tab. The first weakened section is configured to be fractured when the tab is pulled. The first weakened section may extend at least partially around the lip of the container.

In a preferred embodiment, the sidewall of the container includes an inner surface and an outer surface, the lip cover includes an inner portion that is positioned adjacent the inner surface of the container and an outer portion that is positioned adjacent the outer surface of the container. The first weakened section may extend around the lip of the container. Fracturing, tearing or breaking the first weakened section separates the inner and outer portions of the lip cover. Preferably, the tab is connected to a tear member that is configured to break the first weakened section when the tab is pulled. In a preferred embodiment, the first weakened section includes first and second opposite ends. The first end is connected to the tab and the second end is connected to the connection member. Preferably, the connection member includes first and second opposite ends. The first end is connected to the first weakened section and the second end is connected to a second weakened section defined in the lid cover.

In a preferred embodiment, the sidewall of the container includes an inside surface and an outside surface and the tab is positioned adjacent one of the inside or outside surface. Preferably, the lip cover is temporarily adhered to the lip, and pulling the tab peels at least a portion of the lip cover from the cup. The lid cover may be temporarily adhered to the lid. The lid cover may envelop the lid.

In a preferred embodiment, the lid cover includes a weakened section that when fractured allows removal of the lid cover from the lid. Preferably, the connection member includes first and second opposite ends, the first end is connected to the lip cover and the second end is connected to the weakened section. In a preferred embodiment, the lid includes a drinking opening therein and the lid cover spans, covers or seals the drinking opening. At least one of the lid cover and the lip cover may include a sanitizer associated therewith. A sanitizing member may be disposed between the lid cover and the lid, such that after the lid cover is detached from the lid, the sanitizing member can be used to sanitize at least one of the lid or the container.

In accordance with another aspect of the present invention there is provided a method of putting a lid on a container that includes at least one sidewall, a bottom, a lip and an open top. The method includes removing a seal assembly that includes a lid cover that is secured over at least a portion of the lid from the container, removing the lid cover from the lid, and placing the lid on the container. The seal assembly may include a lip cover that is secured to the lip of the container and a connection member that extends between the lip cover and the lid cover. The step of removing the seal assembly from the container may include removing the lip cover from the container. Preferably, the lip cover extends around the lip and defines a central opening. The lip cover includes a tab, and the method includes pulling the tab to remove the lip cover from the cup. The method may also include pulling the tab to remove both the lip cover from the lip and the lid cover from the lid.

In a preferred embodiment, at least a first weakened section is formed in the lip cover adjacent to the tab, and the method includes fracturing the first weakened section when the tab is pulled. The first weakened section includes first and second opposite ends. The first end is connected to the tab and the second end is connected to the connection member. The connection member includes first and second opposite ends. The first end is connected to the first weakened section and the second end is connected to a second weakened section defined in the lid cover. The method includes fracturing the first and section weakened sections when the tab is pulled.

In a preferred embodiment, the lid cover includes a tab, and the method includes pulling the tab to remove the lid cover from the lid. The seal assembly may include a sanitizing member associated therewith, and the method may include sanitizing at least one of the lid or the container with the sanitizing member.

The inventive cup and lid assembly, seal assembly, lid cover assembly and the like taught herein also include methods for use thereof. For example, the present invention includes a method of putting a lid on a cup or container that includes a sidewall, a bottom, a lip and an open top, the method includes the steps of (a) detaching a seal assembly that includes a lid cover that is temporarily attached, secured or coupled to the lid from the cup or container, (b) removing the lid cover from the lid, and (c) placing the lid on the cup or container. In a preferred embodiment, the seal assembly includes a connection member that is temporarily attached to the cup or container, and the method also includes the step of detaching the connection member from the container or cup. The container or cup includes an inner surface and outer surface and the connection member is connected to one or both of the inner surface and outer surface of the cup. Steps (a) and (b) can be reversed and the lid cover can be removed from the lid before the other portion of the seal assembly is removed from the cup or container.

In a preferred embodiment, the seal assembly includes a lip cover that is temporarily attached, secured or coupled to the lip or the entire cup, and the method includes the step of removing the lip cover from the lip/cup. In one embodiment, the lip cover spans the open top. In another embodiment, the lip cover extends circumferentially around the lip. The lip cover can include a tab, and the method includes grasping the tab to begin the step of removing the lip cover from the lip/cup. The lip cover can also include a skirt member that extends downwardly and is temporarily attached to an outer surface and/or an inner surface of the sidewall of the cup. The lid includes a drinking opening therein, and the lid cover spans the drinking opening.

In a preferred embodiment, at least one of the lid cover and the lip cover include a sanitizer, sanitizing fluid, sanitizing member or some mean of sanitizing. In one embodiment, a sanitizing member is disposed between the lid cover and the lid, and after step (b) above, the method includes using the sanitizing member to sanitize at least one of the lid or the cup/container.

In a preferred embodiment, the present invention is a container and lid assembly that includes a container having a sidewall, a bottom, a lip and an open top, a lid that includes a skirt, a seal assembly that includes a lip cover, a lid cover, and a connection member extending between the lip cover and the lid cover. The lip cover is temporarily attached, secured or connected to at least a portion of the lip of the container and the lid cover is temporarily attached, secured or connected to at least a portion of the lid of the container. The lip cover may span the open top of the container. In any container, no matter the shape, for the purposes of the claims, a sidewall can include a plurality of sidewalls that meet at corners. The lip cover may extend circumferentially around the lip. The lip cover may include first and second free ends. The first free end may include a tab that overlaps the second free end and the tab can be grasped to remove the lip cover off the lip (e.g., via pulling, tearing, etc.). The lip cover may be unbroken circumferentially. The lip cover can include include a skirt member that extends downwardly and is temporarily attached or secured to an outer surface of the sidewall of the container. The tab may be on the skirt member.

In a preferred embodiment, the lid includes a drinking opening therein, and the lid cover spans the drinking opening. Preferably at least one of the lid cover and the lip cover include a sanitizer. A sanitizing member may be disposed between the lid cover and the lid, such that after the lid cover is detached from the lid, the sanitizing member can be used to sanitize at least one of the lid or the container.

In a preferred embodiment, the present invention incudes a method of putting a lid on a container that includes a sidewall, a bottom, a lip and an open top. The method includes detaching a seal assembly from the container, wherein the seal assembly includes a lid cover that is temporarily attached to the lid, removing the lid cover from the lid, and placing the lid on the container. The seal assembly may include a connection member that is temporarily attached, secured or connected to the container and the method further includes the step of detaching the connection member from the container. The container includes an inner surface and outer surface and the connection member is connected to one or both of the inner surface and outer surface of the container. Preferably, the seal assembly includes a lip cover that is temporarily attached to the lip, and the method further includes the step of removing the lip cover from the lip/cup.

In a preferred embodiment, the present invention includes a lid assembly for use with a container that includes a sidewall, a bottom, a lip and an open top. The lid assembly includes a lid that includes a skirt, a lip cover, and a connection member extending between the lip cover and the lid. The lip cover is configured to be temporarily attached, secured or connected to the lip of the container. In a preferred embodiment, the present invention includes a method of putting a lid on a container using the lid assembly described above. The method includes detaching the lip cover from the lip/cup, fracturing the connection member to separate the lid from the lip cover, and placing the lid on the container.

In a preferred embodiment, the present invention includes a seal assembly for use with a container that includes a sidewall, a bottom, a lip and an open top. The seal assembly includes a lid cover that is temporarily attached to a lid, and a connection member that is temporarily attached to the container. The container includes an inner surface and outer surface, and the connection member is connected to one or both of the inner surface and outer surface of the container. In a preferred embodiment, the present invention includes a method of putting a lid on a container using the seal assembly described above. The method includes detaching the connection member from the container, detaching the lid cover from the lid, and placing the lid on the container.

The methods described above also include the steps of removing the cup and lid assembly from a stack of cup and lid assemblies and then performing the steps discussed above. See also U.S. Publication No. 2009/0223969, the entirety of which is incorporated herein by reference.

BRIEF DESCRIPTION OF THE DRAWINGS

Like numerals refer to like parts throughout the several views of the drawings.

DETAILED DESCRIPTION OF THE PREFERRED EMBODIMENTS

Figure 1:
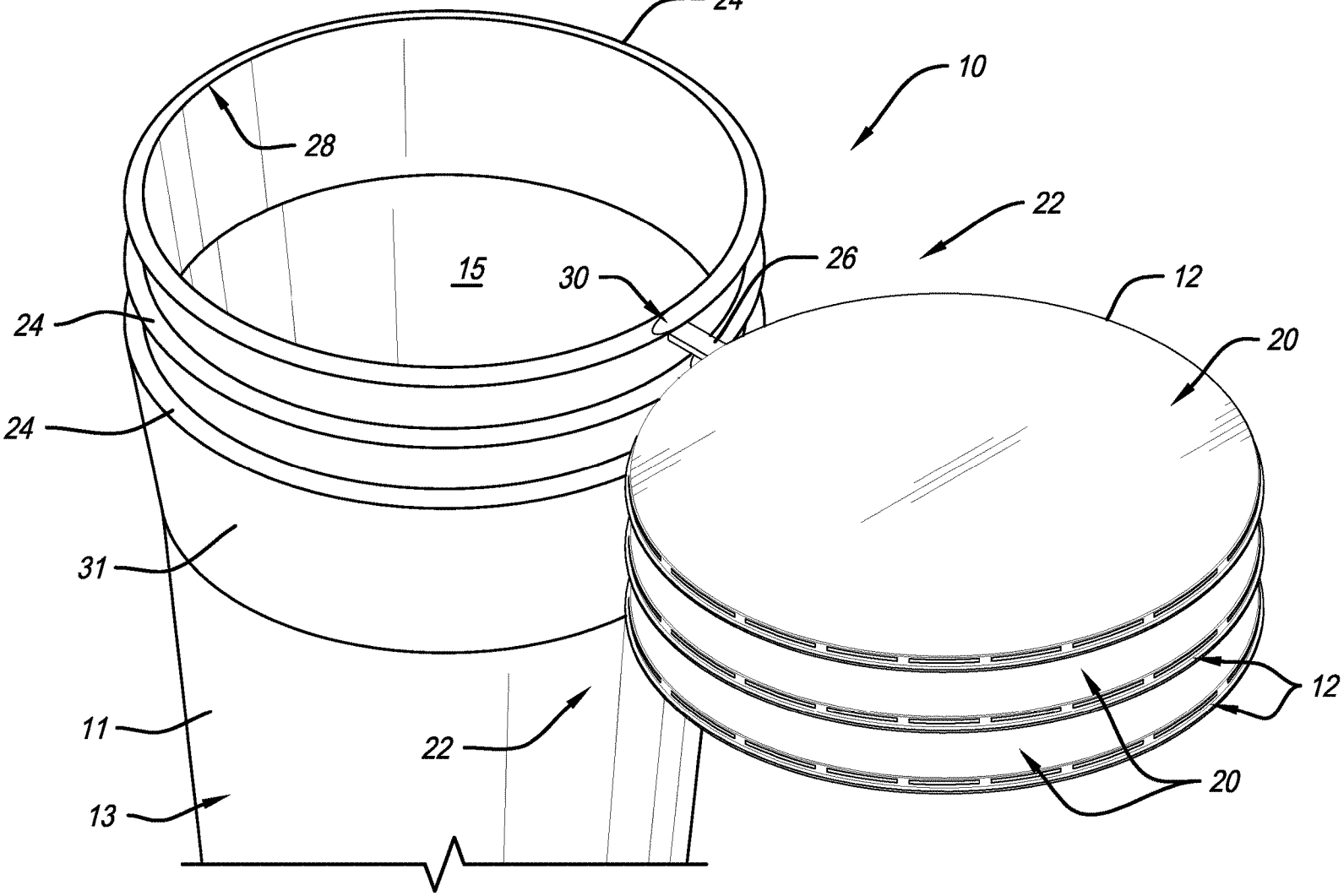
FIG. 1 is a perspective view of a plurality of stacked cup and lid assemblies in accordance with a preferred embodiment of the present invention attached thereto.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the-disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term. The scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Referring now to the drawings, wherein the showings are for purposes of illustrating the present invention and not for purposes of limiting the same, FIGS. 1-27 show embodiments of container and lid assemblies and seal assemblies that can be used therewith. It will be appreciated that any open container that includes a lid is within the scope of the present invention. In particular, a container or cup 11 that includes a sidewall 13, a bottom 14, a lip 16 and an open top is within the scope of the present invention. It will be appreciated that a cup is generally a container for holding liquid. Accordingly, the term cup is used throughout the specification as an exemplary embodiment of a container. However, containers for holding or dispensing other items, such as condiments, food, soup, meal preparation, items, hardware, and the like are also within the scope of the present invention. Furthermore, containers within the scope of the present invention can be round, square, rectangular, etc. It will be appreciated that the lip is essentially the top edge or surface of the sidewalls of the container.

Figure 2:
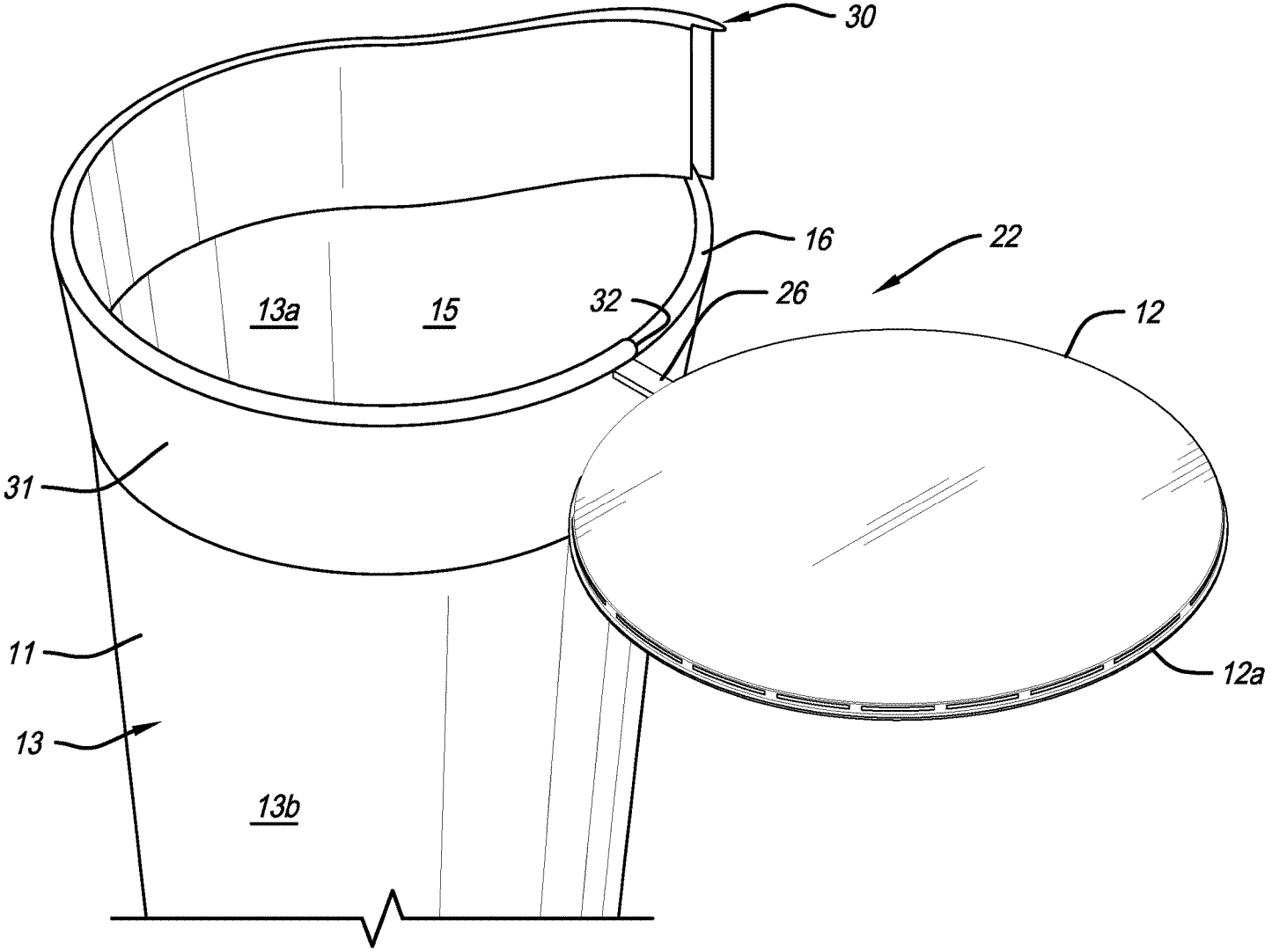
FIG. 2 is a perspective view of a cup and lid assembly with a portion of the lip cover pulled upwardly from the cup.

FIGS. 1-2 show a preferred embodiment of a container and lid assembly or cup and lid assembly 10 that includes a container or cup 11 having a sidewall 13, a bottom 14, a lip 16 and an open top 15, a lid 12 that includes a skirt 12*a*, and a seal assembly 22 that includes a lip cover 24, a lid cover 20, and a connection member 26 extending between the lip cover 24 and the lid cover 20. The lip cover 24 preferably extends down and covers at least a portion of the inner and outer surfaces 13*a* and 13*b* of the sidewall (or sidewalls in the case of a polygonal container). The portion of the lip cover 24 extending downwardly may be called a skirt member 31 herein.

In a preferred embodiment, the lip cover 24 is temporarily attached to the lip and/or sidewall of the cup 11 and the lid cover 20 is temporarily attached to the lid 12 of the cup 11. FIG. 1 shows a plurality of cups 11 in a stack formation and with the lid covers 20 and lids 12 extending to the side. For example, an adhesive (e.g., a food grade adhesive) can be used to temporarily adhere the seal assembly 22 to the cup 11 and lid 12 (see adhesive 21 in FIG. 17).

Figure 17:
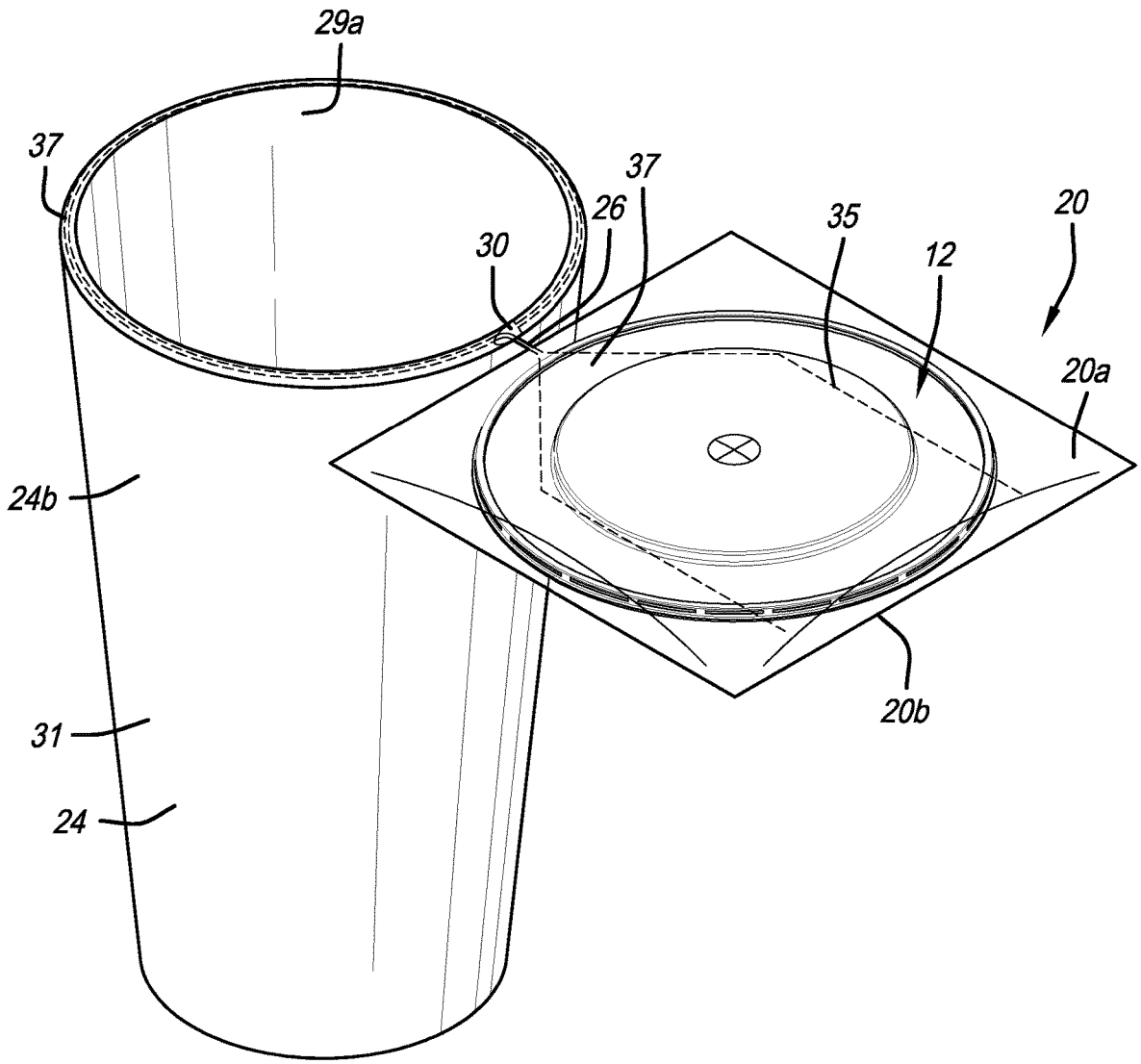
FIG. 17 is a perspective view of a cup and lid assembly with a tear portion or weakened section on the lip cover and lid cover in accordance with a preferred embodiment of the present invention.

It will be appreciated that the purpose of the lid cover 20 and lip cover 24 is to seal or protect the lid 12 and the lip 16, respectively. The lid cover 20 and lip cover 24 can be connected via the temporary adhesive or the like so that they can be peeled off or otherwise detached when the user is ready to use the cup and lid, as discussed further below. The lid cover 20 and lip cover 24 can be made of a plastic, paper or other material known in the art for sealing, covering or protecting. The lip cover 24 can cover any portion or all of the cup. In other words, as shown in FIG. 17, the lip cover 24 extends almost to or all the way to the bottom of the cup. This is still a lip cover as it covers the lip of the cup.

As shown in FIG. 1, in a preferred embodiment, the lip cover 24 extends circumferentially around the lip 16. This allows the cup and lid assemblies 10, and, in particular, the cups 11 to be stacked or nested. In other words, there is a central opening 28 defined through or by the lip cover 24 that allows a cup 11 to be inserted therethrough.

In a preferred embodiment, The lip cover 24 includes a free end and/or tab 30 that allows a user to grasp and peel the lip cover 24 off circumferentially around the lip. In a preferred embodiment, the tab 30 is located at a first free end that overlaps a second free end of the hoop shaped lip cover, and is located on the top of the cup or above the lip. This allows the user to grasp the tab 30 to pull the lip cover 24 off the lip, as shown in FIG. 2.

After the lip cover 24 has been removed, the lid cover 20 can be peeled off of or otherwise removed from the lid 12. In a preferred embodiment, the removal of the seal assembly 22, including both the lip and lid covers, can be performed in a single continuous motion where the user pulls on the tab on the lip cover and peels or pulls off the lip cover. Next, because the connection member may be located at the end of the 360° lip cover, the removed lip cover together with the connection member and lid cover and lid are separated from the cup. The user can then peel off the lid cover. It will be appreciated, however, that the steps can be done in any order. For example, the connection member 26 can be broken or torn prior to the removal of the lip cover 24.

Figure 3:
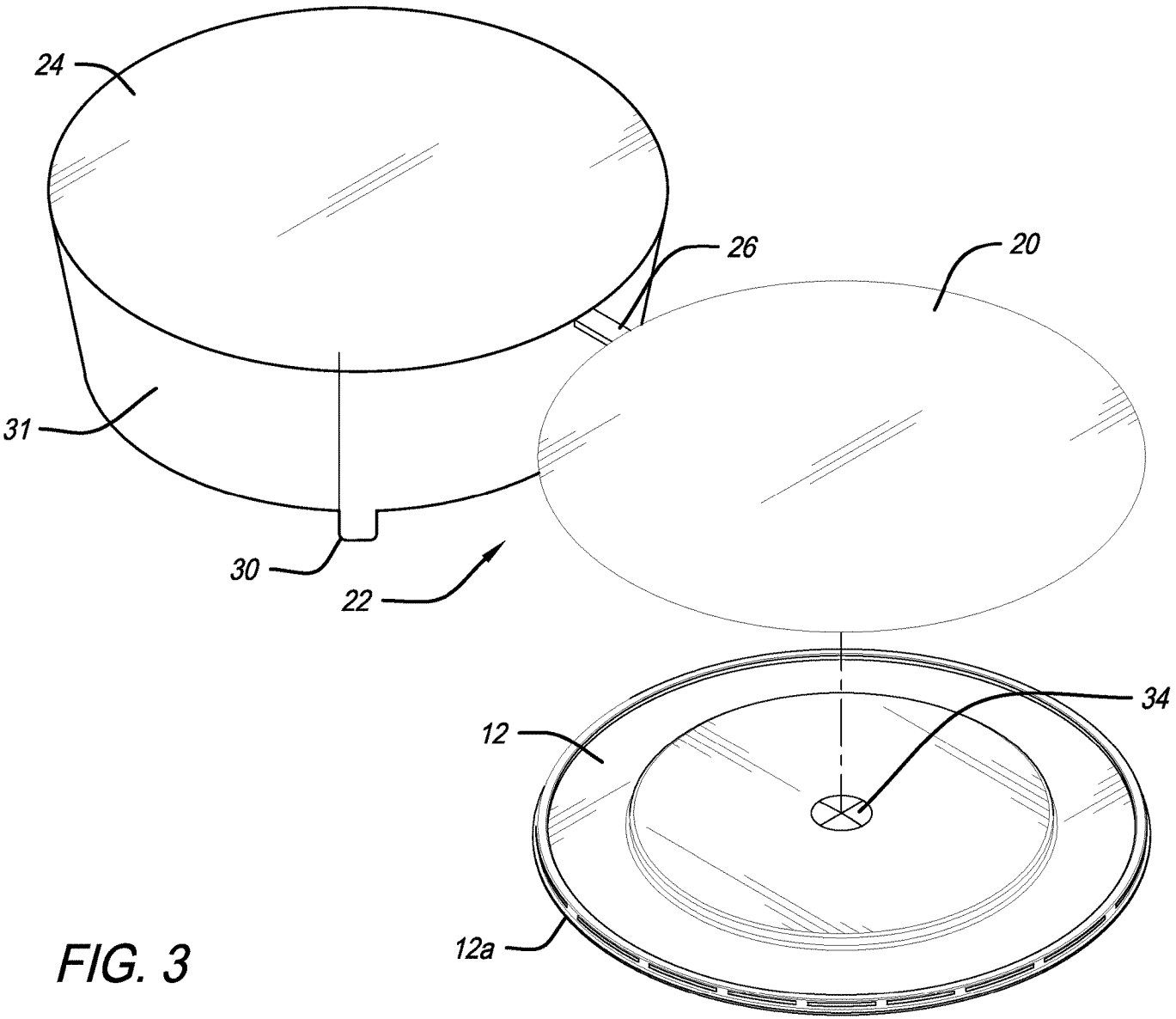
FIG. 3 is an exploded perspective view of a seal assembly with a lip cover that covers the open top of the cup.
Figure 4:
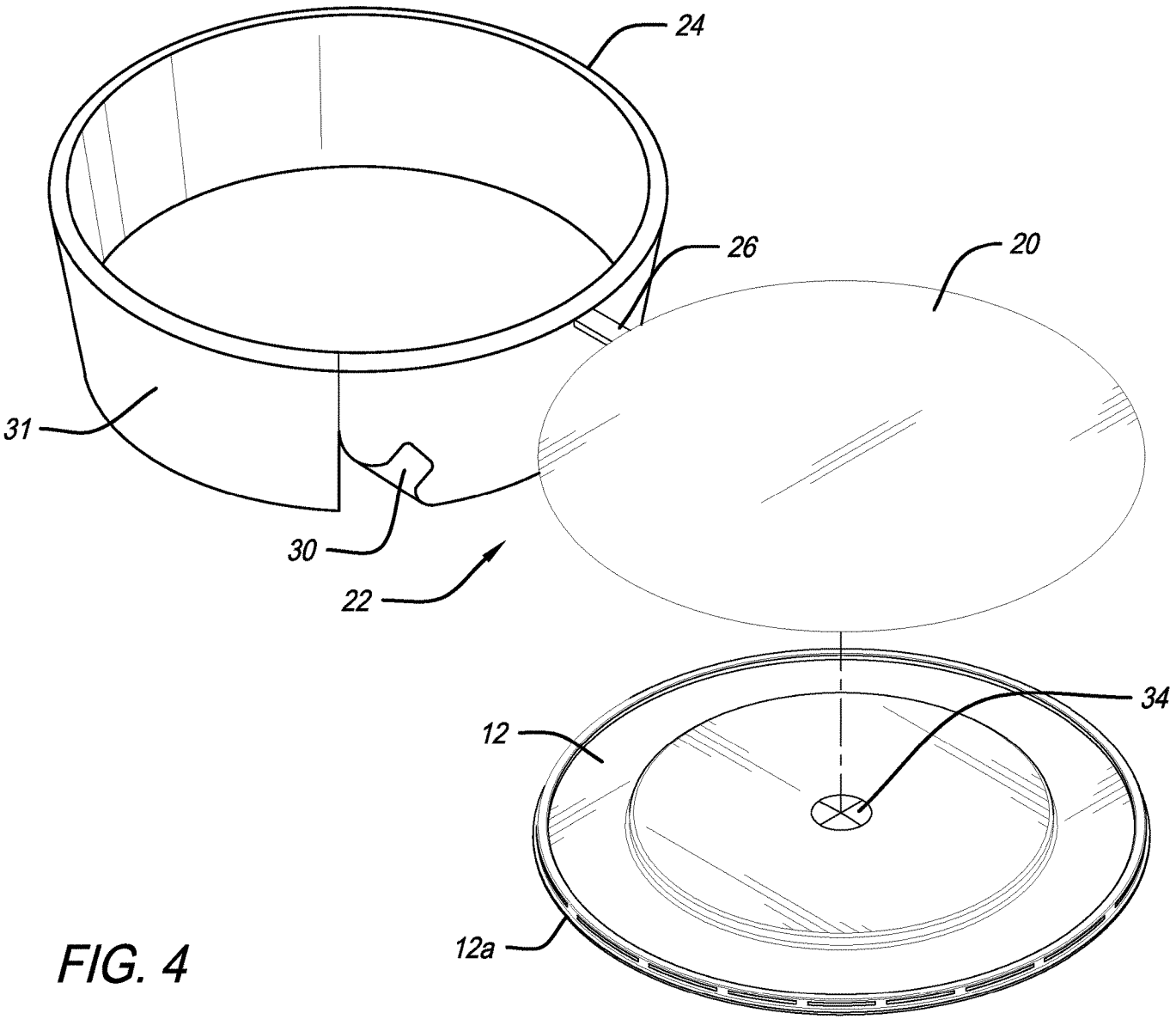
FIG. 4 is an exploded perspective view of a seal assembly with a lip cover that shows a tab being pulled upwardly.
Figure 5:
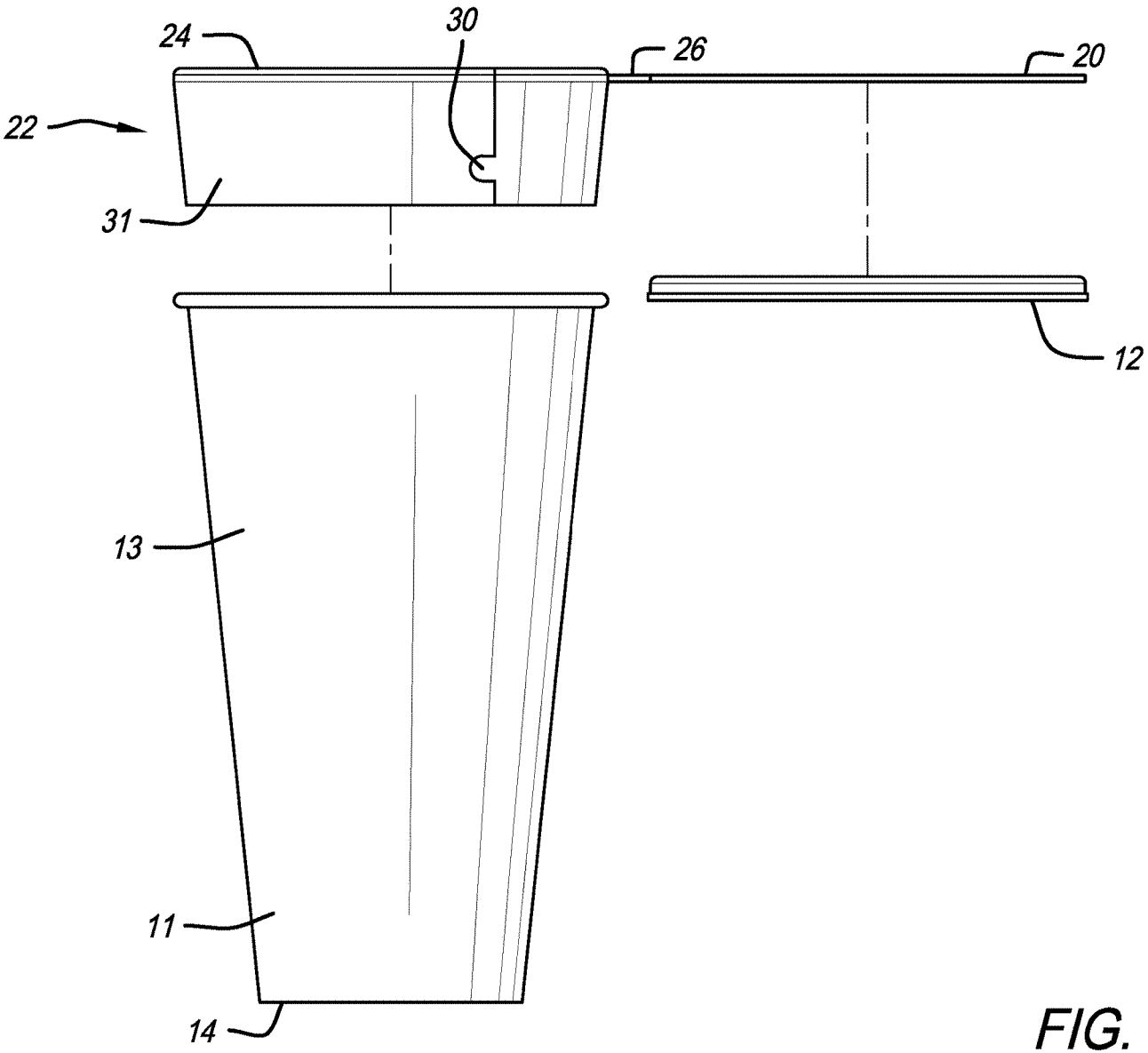
FIG. 5 is an exploded side elevation of a cup and lid assembly.

FIGS. 3-5 show different preferred embodiments of seal assemblies 22. FIG. 3 shows a seal assembly where the lip cover 24 spans the entire open top 15 of the cup 11 (and is sealed or adhered to the lip). FIG. 4 shows a seal assembly 22 where the lip cover 24 extends circumferentially around the lip. In FIGS. 3-4 the tab 30 is located on the bottom of (or extends downwardly from) the lip cover 24 (or the skirt thereof) As shown in FIG. 4, the tab 30 is grasped and pulled upwardly to start the seal removal or detaching process.

FIG. 5 shows an exploded side view of the cup and lid assembly 10. As shown in FIG. 5, the lip cover 24 includes skirt member 31 that extends downwardly and is temporarily attached to an outer surface of the sidewall 13 of the cup 11. The skirt member 31 therefore protects further down the sidewall and can extend as far down the cup as desired. FIG. 5 also shows tab 30 on the skirt member 31 and is pulled horizontally or sideways to start the detaching process. It will be appreciated that any of the embodiments discussed herein may or can include more than one tab for removing both the lip cover and/or the lid cover.

Figure 6:
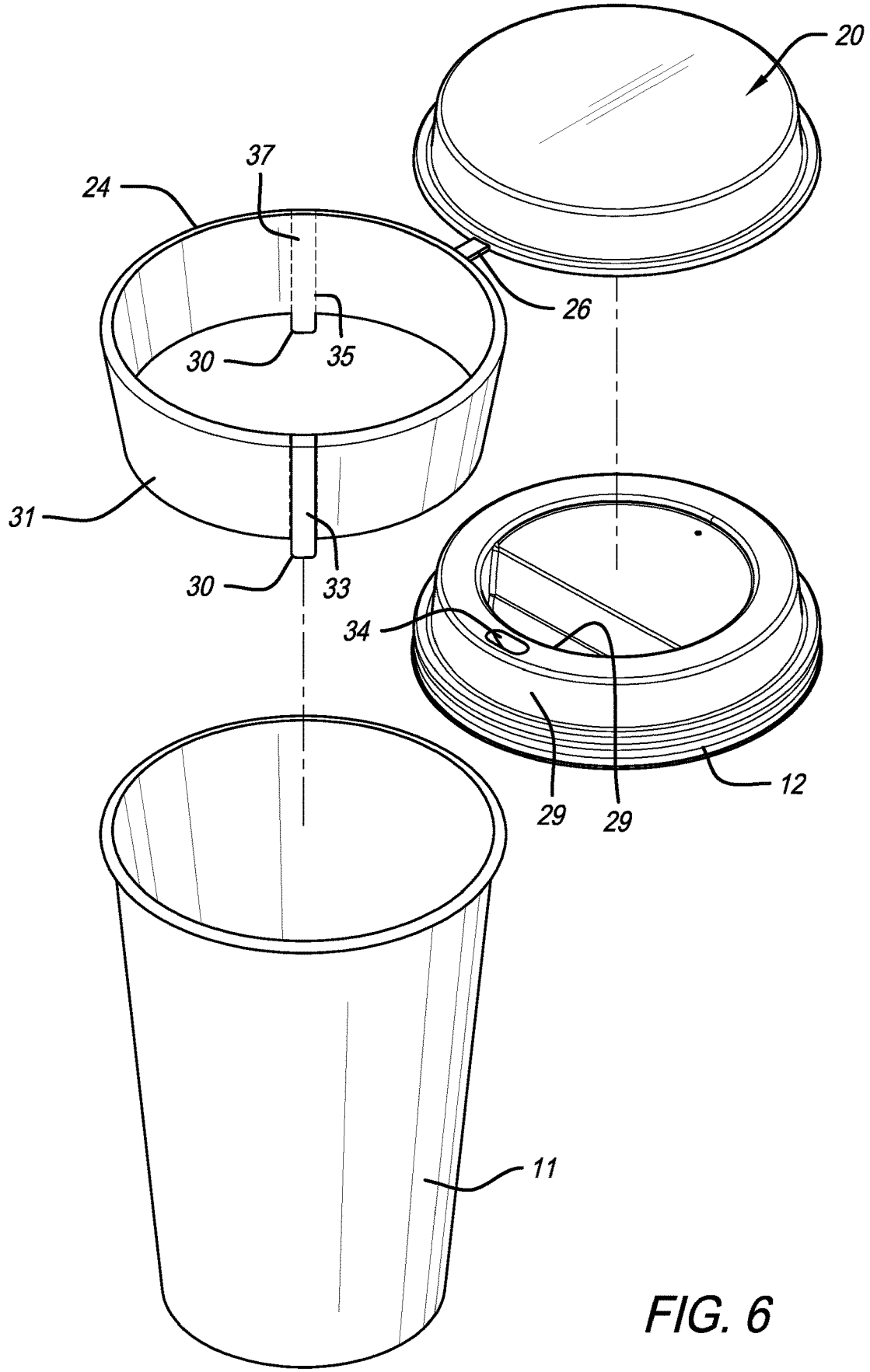
FIG. 6 is an exploded perspective view of a hot liquid cup and lid with a seal assembly exploded therefrom.
Figure 7:
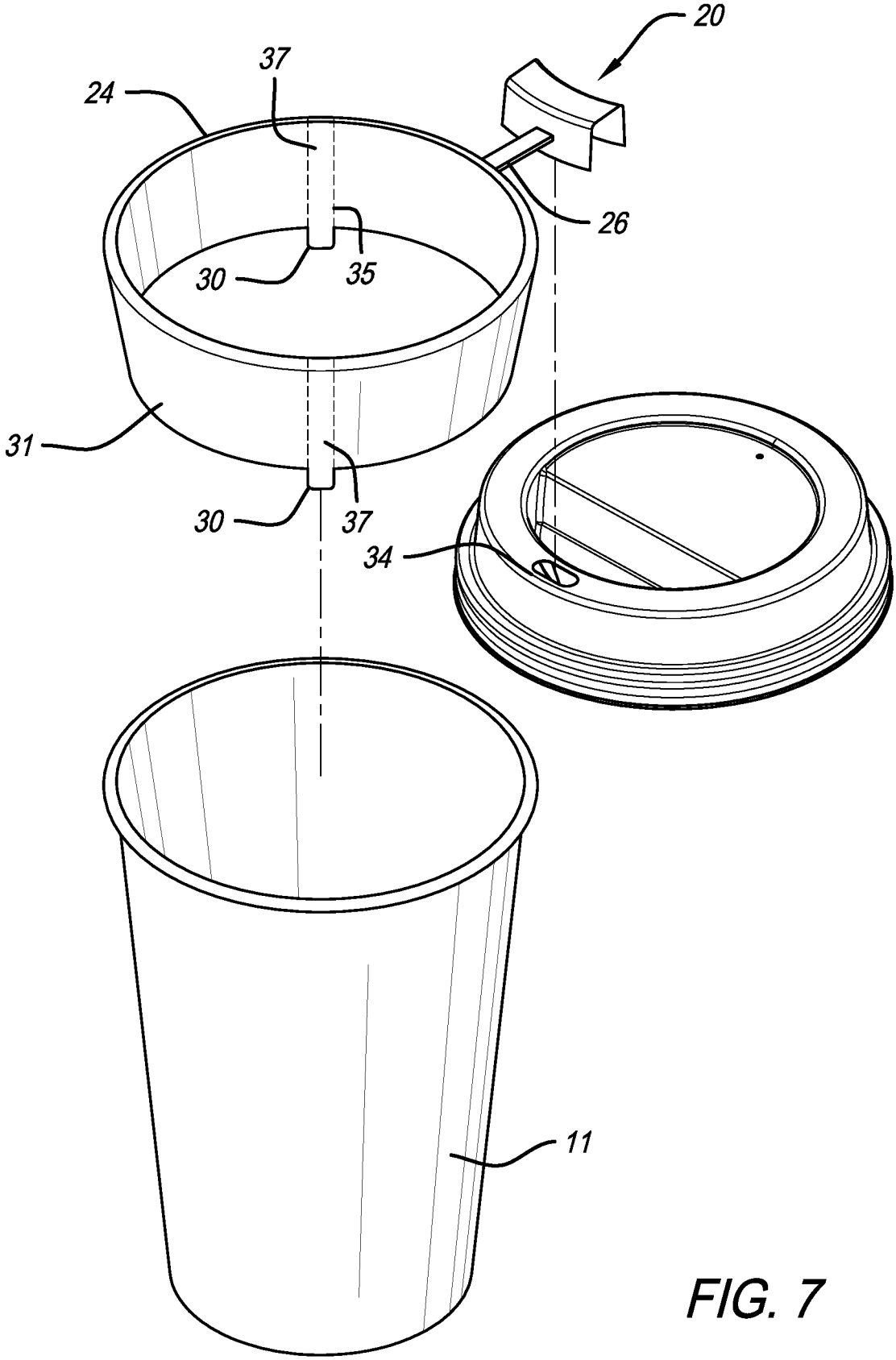
FIG. 7 is an exploded perspective view of a hot liquid cup and lid with another seal assembly exploded therefrom.

As will be appreciated by those of ordinary skill in the art, lids 12 include drinking openings 34 therein. Soft drink lids, as shown in FIG. 3 typically include drinking openings 34 configured as a straw opening. As shown in FIGS. 6 and 7, hot drink lids typically include drinking openings 34 configured for the user to place their lips directly on the top of the lid and around the drinking opening 34. The lid cover 20 can also include one or more tabs for aiding in removal of the lid cover.

FIG. 6 shows a seal assembly 22 where the lip cover 24 is an unbroken hoop (or it could be broken or include ends) that extends circumferentially around the lip. The hoop shaped lip cover 24 can include a tab 30 that a user can grab to start the detachment process. In the embodiment shown in FIG. 6, the tab is part of a tear member 33 that is positioned between the lip cover 24 and the cup 11 or between two layers of the lip cover and that tears or breaks the lip cover on one or both sides of the tear member 33 to form a separation or tear opening in the lip member so that it can be removed from the cup. The tear member preferably extends over the lip of the cup and into the inside of the cup. This embodiment (or any embodiment herein) may or may not include adhesive, and/or can be vacuum formed or otherwise formed or secured to the cup. The lip member can also include a weakened section or tear lines therein that makes the tearing easier. FIG. 6 shows a tab 30 and tear member 33 on the inside and the outside of the cup. This allows the user to start the tearing from the inside or the outside of the cup. Only one or the other of the inside or outside tab may be used. The lip cover 24 may be tearable or include a seam or weakened section that allows a user to pull on the tab, tear or break a portion of the lip cover and remove the lip cover. In another embodiment, as shown in FIG. 7, the tear member can be omitted and one or more weakened lines 35 that form a weakened section or tear portion 37 and pulling on the tab 30 can break the weakened section(s) or line(s) and open a strip opening in the lip cover 24.

Furthermore, hot drink lids typically include contoured surfaces 29 that make it easier for drinking. Therefore, the lid cover 20 can be configured to fit the contours and contoured surfaces 35 of the top surface and/or the side surfaces/skirt of the lid 12. As shown in FIG. 7, the lid cover 20 can be configured to only cover a portion of the lid 12. For example, the lid cover 20 may only cover the portions of the lid where a user typically places their mouth. In the lid shown in FIG. 3, the lid portion may only cover the drinking or straw opening and/or a portion around the straw opening. The lid cover 20 preferably spans the drinking opening 34 no matter the size of the lid cover 20.

In a preferred embodiment, one or both of the lid cover 20 and the lip cover 24 include a sanitizer thereon (e.g., on the bottom surface or on any surface of the lid cover and/or lip cover) that provides extra protection for the lid and/or cup. Any sanitizer is within the scope of the present invention. For example, a sanitizer that kills germs, viruses, bacteria, etc. can be used. Preferably, the sanitizer is a food grade sanitizer that can be safely ingested by users. In a preferred embodiment, the adhesive for attaching the lid cover 20 and lip cover 24 includes a sanitizer mixed therein or thereon. Therefore, when the lid cover 20 and/or lip cover 24 is/are removed, the underlying surface is sanitized and clean. Furthermore, enough sanitizer can be left on the surface so that the user can take a cloth, napkin or the like and wipe away the excess sanitizer, thus providing extra peace of mind.

In another embodiment, the sanitizer can be disposed in a fracturable chamber within the lid cover 20 and/or lip cover 24 such that when the lid cover and/or lip cover is removed the chamber fractures, thereby releasing the sanitizer.

Figure 8:
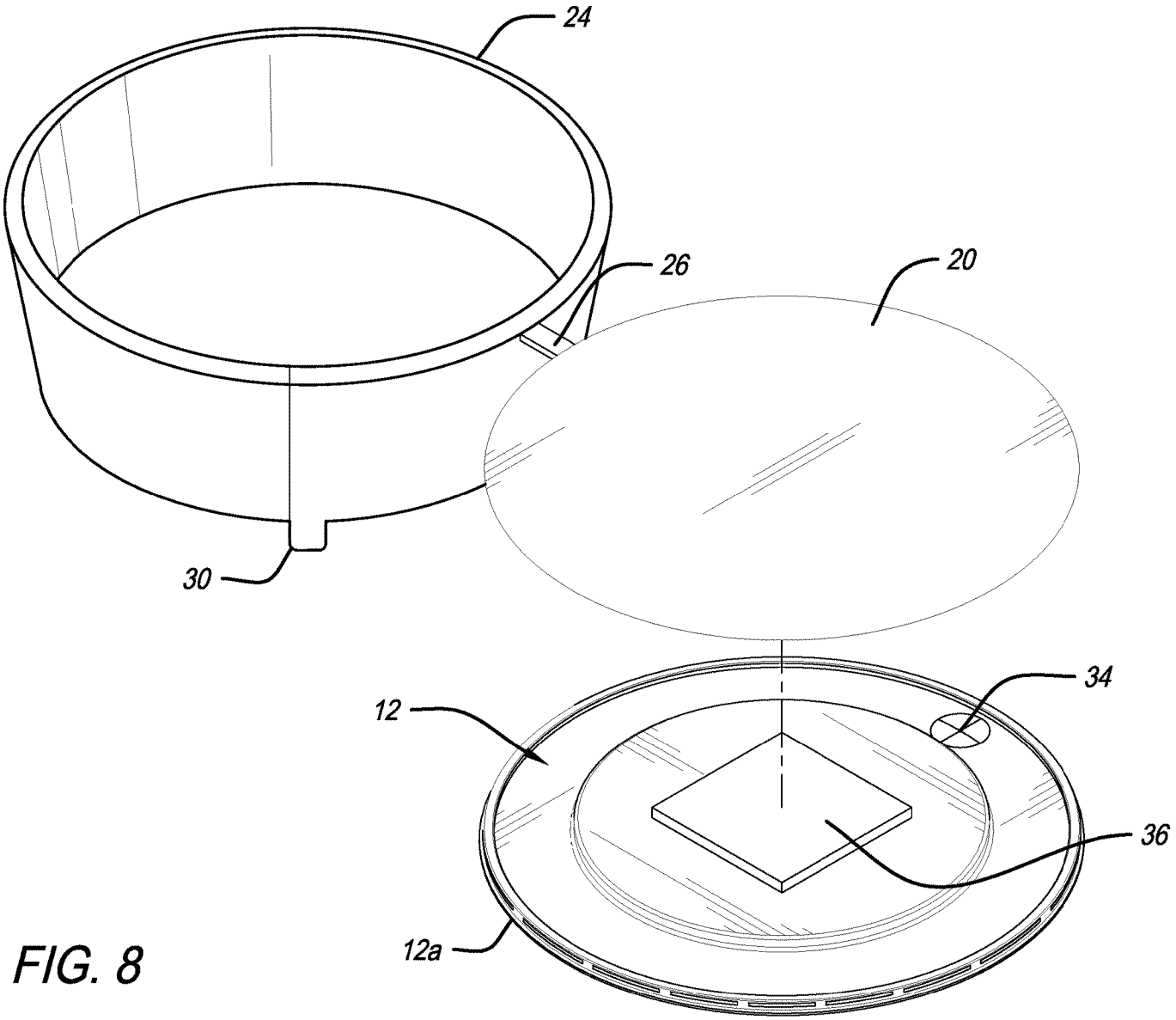
FIG. 8 is an exploded perspective view of a seal assembly and lid with a sanitizing member positioned therebetween.
Figure 9:
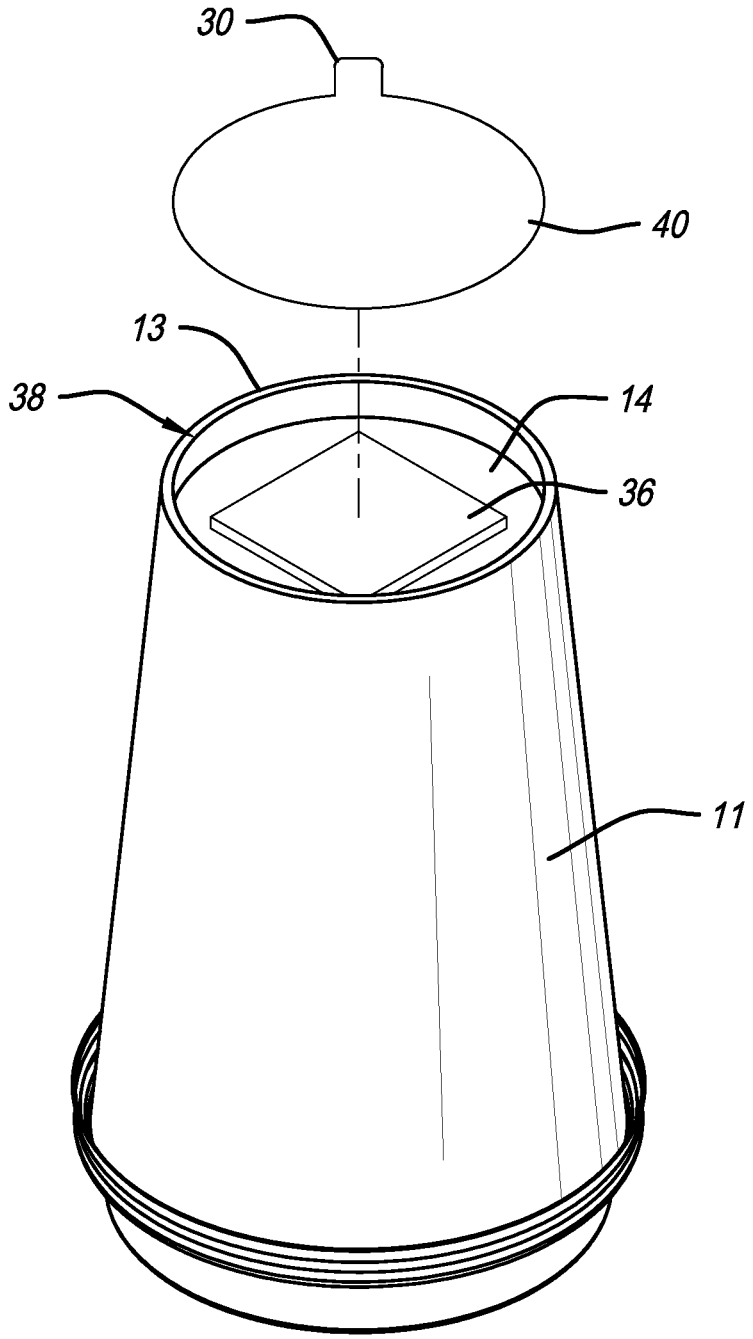
FIG. 9 is a bottom perspective view of a cup with a sanitizing member in the bottom recess thereof and showing the bottom seal exploded therefrom.

As shown in FIG. 8, in a preferred embodiment, a sanitizing member 36 (e.g., a wipe, napkin, cloth or the like that includes sanitizer thereon or therein) is disposed between the lid cover 20 and the lid 12. Therefore, after the lid cover 20 is detached from the lid 12, the sanitizing member 25 can be used to sanitize the lid 12 and/or the cup 11 as desired by the user. The sanitizing member 25 can be positioned between the lid cover and lid or can be placed in a pocket or enclosure in the bottom surface of the lid cover. In another embodiment, where the lip cover 24 spans the open top of the cup, a sanitizing member 25 can be placed inside the cup. In another embodiment, as shown in FIG. 9, the sanitizing member 25 can be positioned in the bottom recess 38 defined by the bottom surface of the bottom 14 of the cup and the bottom portion of the sidewall 13 of the cup. FIG. 9 shows a bottom seal 40 exploded therefrom that can be used to secure the sanitizing member 25 in the recess 38. A tab 30 or the like can be used to pull the bottom seal 40 off of the bottom 14 of the cup to expose the sanitizing member 25. In another embodiment, the sanitizing member 25 can be disposed in a recess formed on the sidewall of the cup and a side seal can span and close the recess. The side and bottom seal scenarios can be used, for example, at a coffee house or in a drive through where the server typically passes a full cup to the customer. In this situation, the customer pulls the bottom or side seal off of the cup, and uses the sanitizing member to clean the cup, lid and/or straw, etc.

In another embodiment, the lid 12, sanitizing member 25 and/or straw can be disposed inside the cup with the lip cover 24 covering the open top of the cup. In use, the user peels the lip cover off of the cup (e.g., via a tab, a tear strip, adhesive or the like) and pulls the clean lid out of the cup for use. The sanitizing member can be used if desired or can be omitted.

Figure 10:
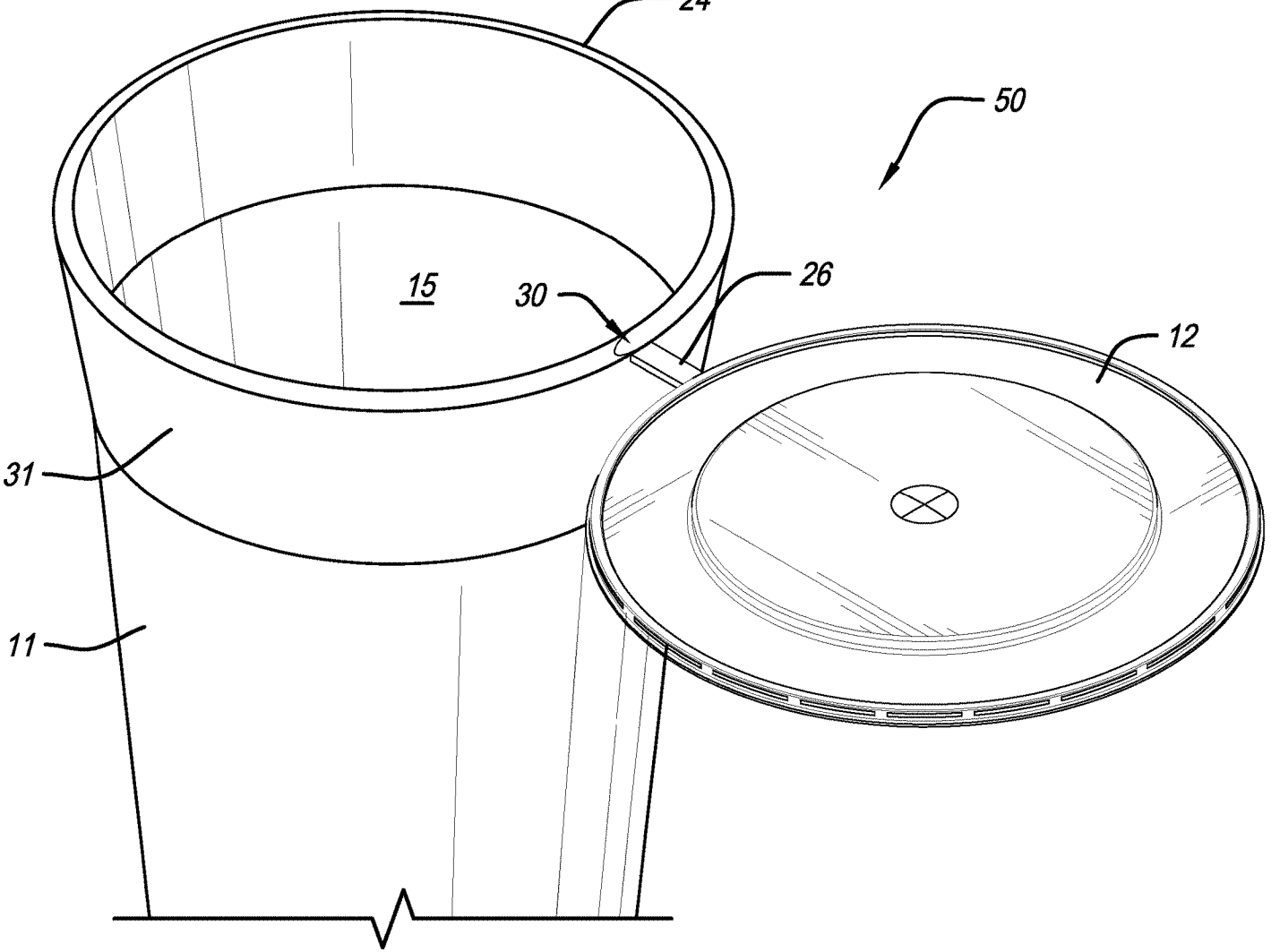
FIG. 10 is a perspective view of a lid assembly on a cup.

FIG. 10 shows another embodiment of the present invention that includes a lid assembly 50 for use with a cup 11. The lid assembly 50 includes a lid 12 that includes a skirt 12*a*, a lip cover 24 that is temporarily attached to the lip 16 of the cup 11 and a connection member 26 extending between the lip cover 24 and the lid 12. In short, in this embodiment, the lip cover 24 is connected directly to the lid 12. Preferably, the connection member 26 is fracturable, breakable or tearable so that the lid 12 can be separated from the lip cover 24 after it is removed from the cup. The lid 12 can include a separate lid cover 20 if desired. The lip cover 24 can span the open top 15 of the cup, can be unbroken or can include a tab 30, as shown in FIG. 10 or can include a tear strip or any other opening or removing scenario or strategy discussed herein. In use, for the embodiment shown in FIG. 10, the tab 30 is pulled upwardly and the lip cover 24 is peeled off or removed from the lip 16. Then the connection member 26 is fractured and the free lid is placed on the cup 11. In an embodiment with a tear strip, the tab is pulled and the tear strip tears around or up the lip cover 24. The connection member 26 is then fractured and the free lid is placed on the cup 11.

Figure 12:
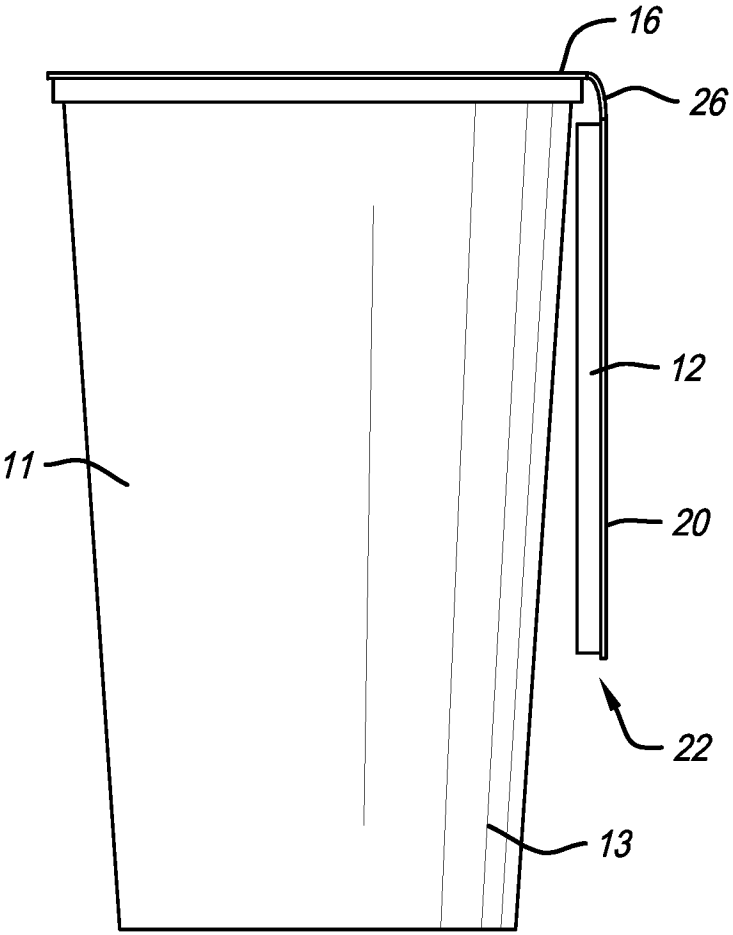
FIG. 12 is another side elevational view of the cup of FIG. 12, rotated 90 degrees.
Figure 11:
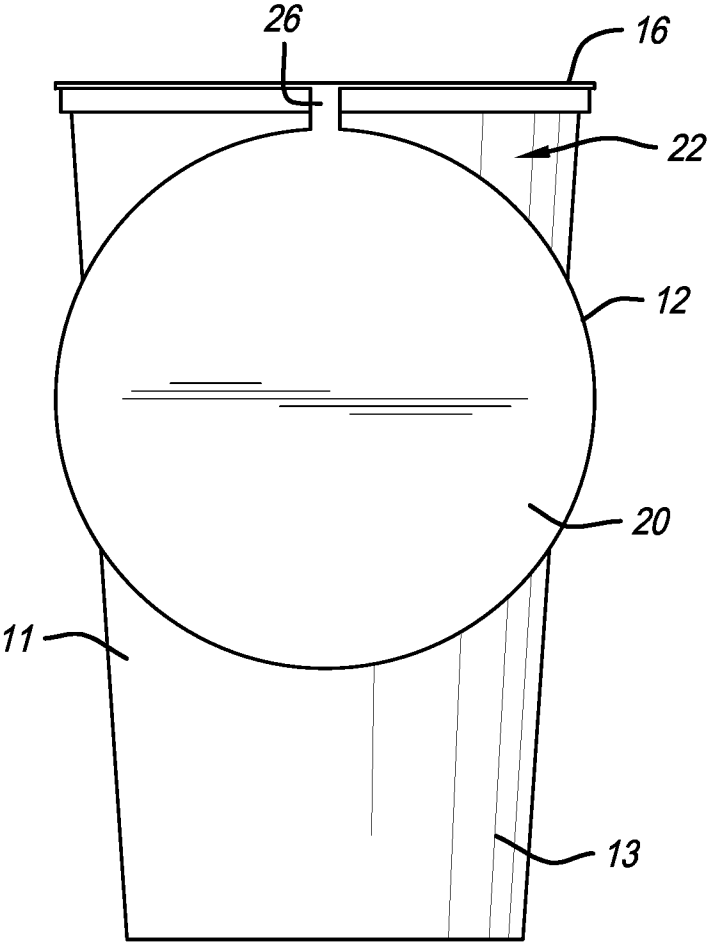
FIG. 11 is a side elevational view of a cup with a seal assembly attached to the side thereof.

FIGS. 11-12 show another embodiment where the seal assembly 22 excludes the combined lip cover (a separate lip cover can be used). In this embodiment, the seal assembly 22 includes a lid cover 20 that is temporarily attached to the lid 12, and a connection member that is temporarily attached to the cup (e.g., by adhesive or the like). In use, the user detaches the connection member 26 from the cup 11, detaches the lid cover 20 from the lid 12, and then places the lid on the cup. The connection member can be adhered or otherwise connected or attached (e.g., velcro, snaps, friction fit, snap fit, etc.) to the outside surface of the cup. In an embodiment, the connection member is long enough that it wraps over the lip and is connected to both the inner surface and outer surface of the cup. In this embodiment, the connection member is also the lip cover.

Figure 13:
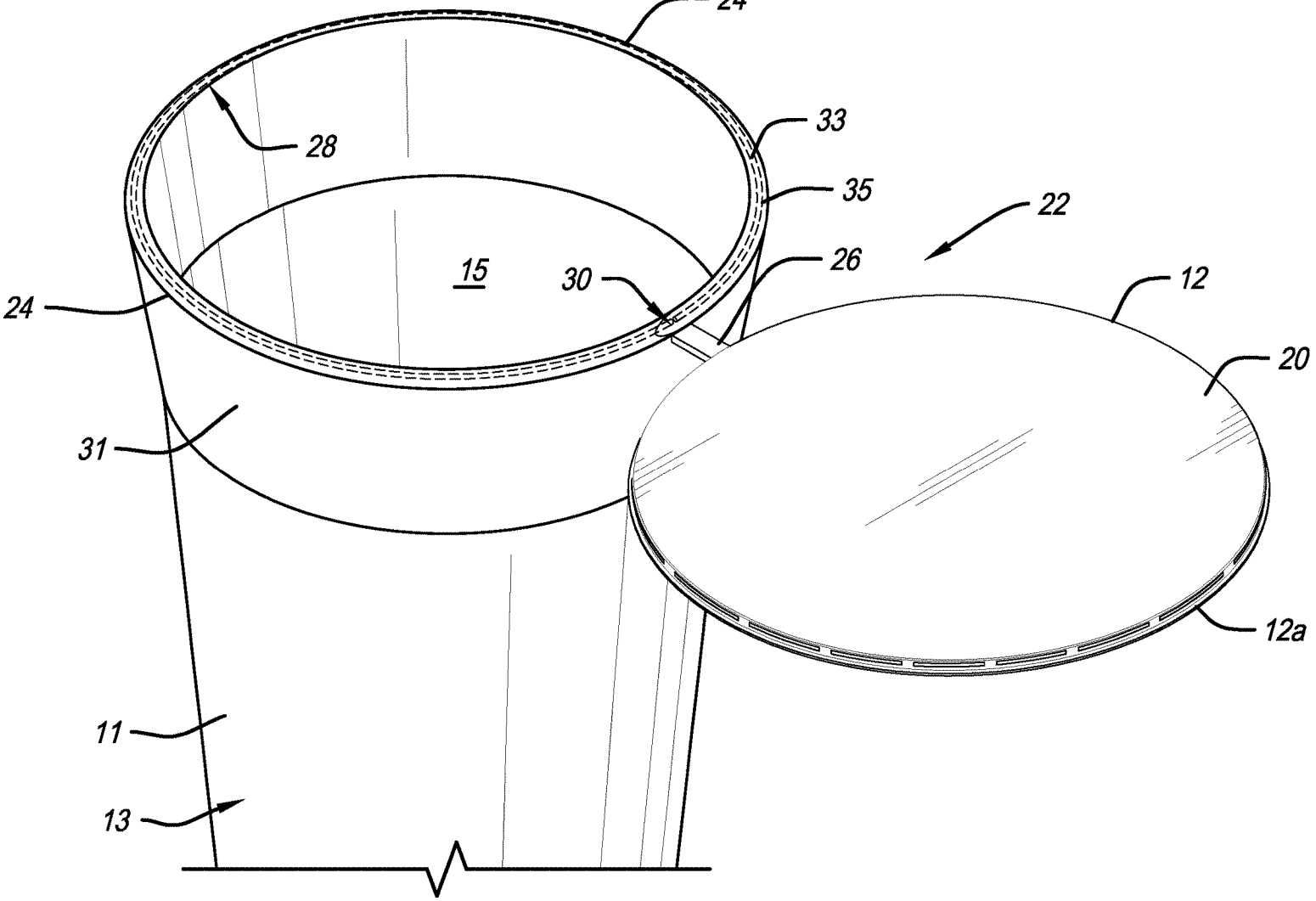
FIG. 13 is a perspective view of a cup and lid assembly with a tear member on the lip cover in accordance with a preferred embodiment of the present invention.
Figure 14:
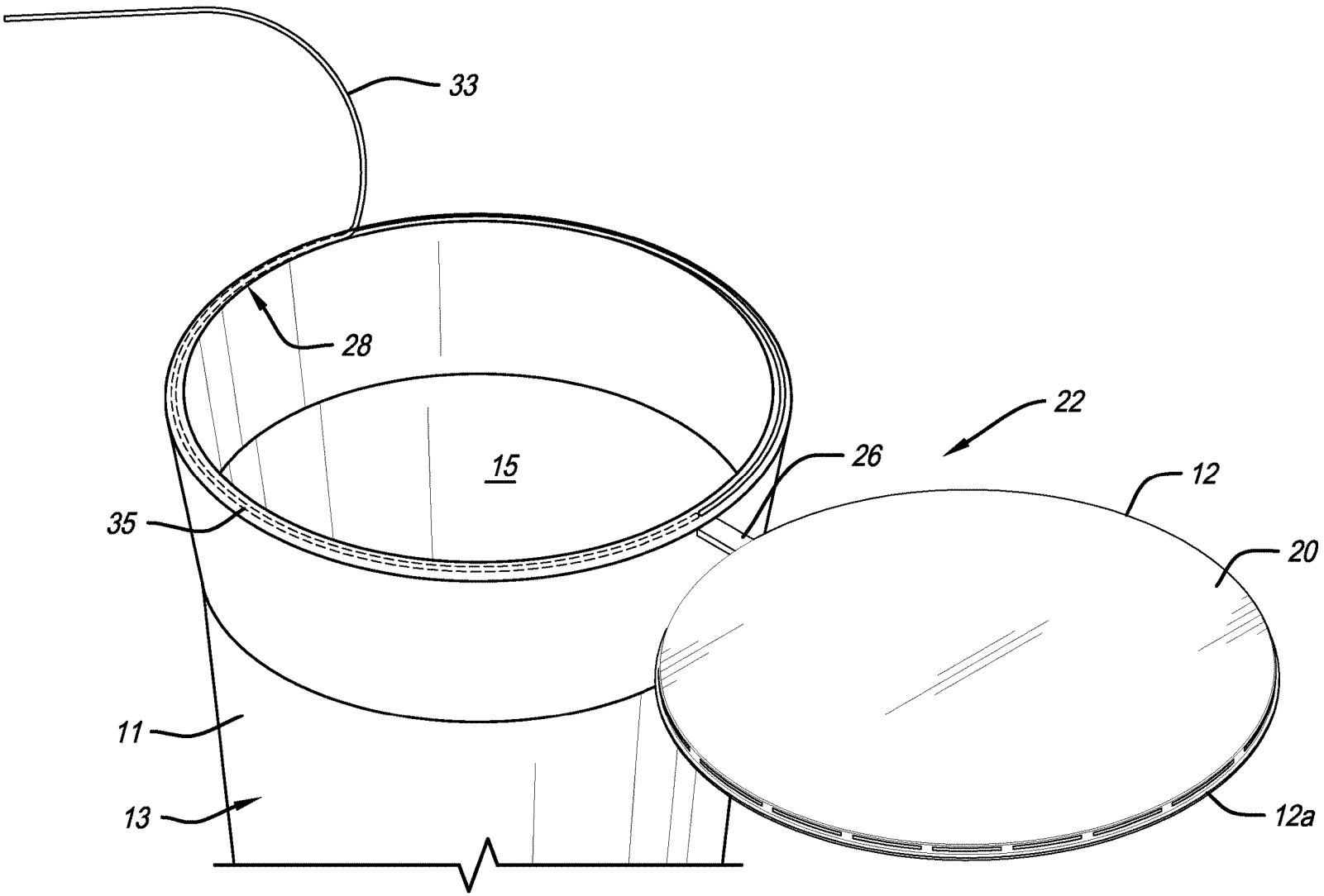
FIG. 14 is a perspective view of the cup and lid assembly of FIG. 13 with the tear member pulled part of the way upwardly.
Figure 15:
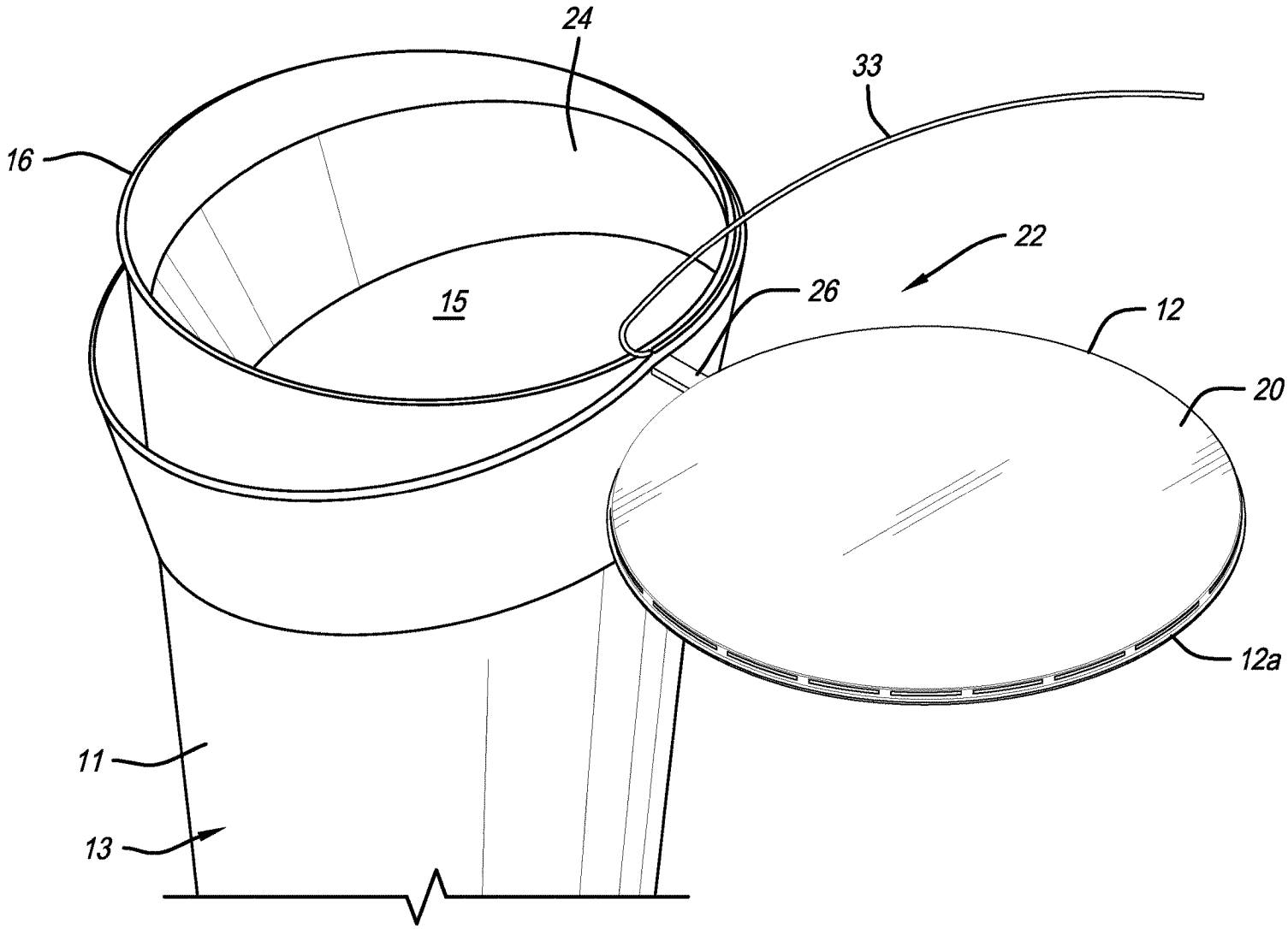
FIG. 15 is a perspective view of the cup and lid assembly of FIG. 13 with the tear member pulled almost all of the way around the lip cover.

FIGS. 13-15 show another embodiment of a seal assembly 22 that includes a tear member 33 or a tear portion 37, similar to the tear member 33 and/or tear portion 37 shown in FIGS. 6 and 7, but wear the "tearing" occurs circumferentially around the lip instead of vertically or upwardly on the side of the lip cover 24. As shown in FIG. 13, the tab 30 can be grasped and the tear member 33 is pulled and tears an opening in the lip cover 24. FIG. 14 shows the tear member 33 partially turn out of the lip cover and FIG. 15 shows the tear member 33 almost all the way torn out and shows the two portions of the lip cover formed by the tearing action starting to fall off of the cup.

Figure 16:
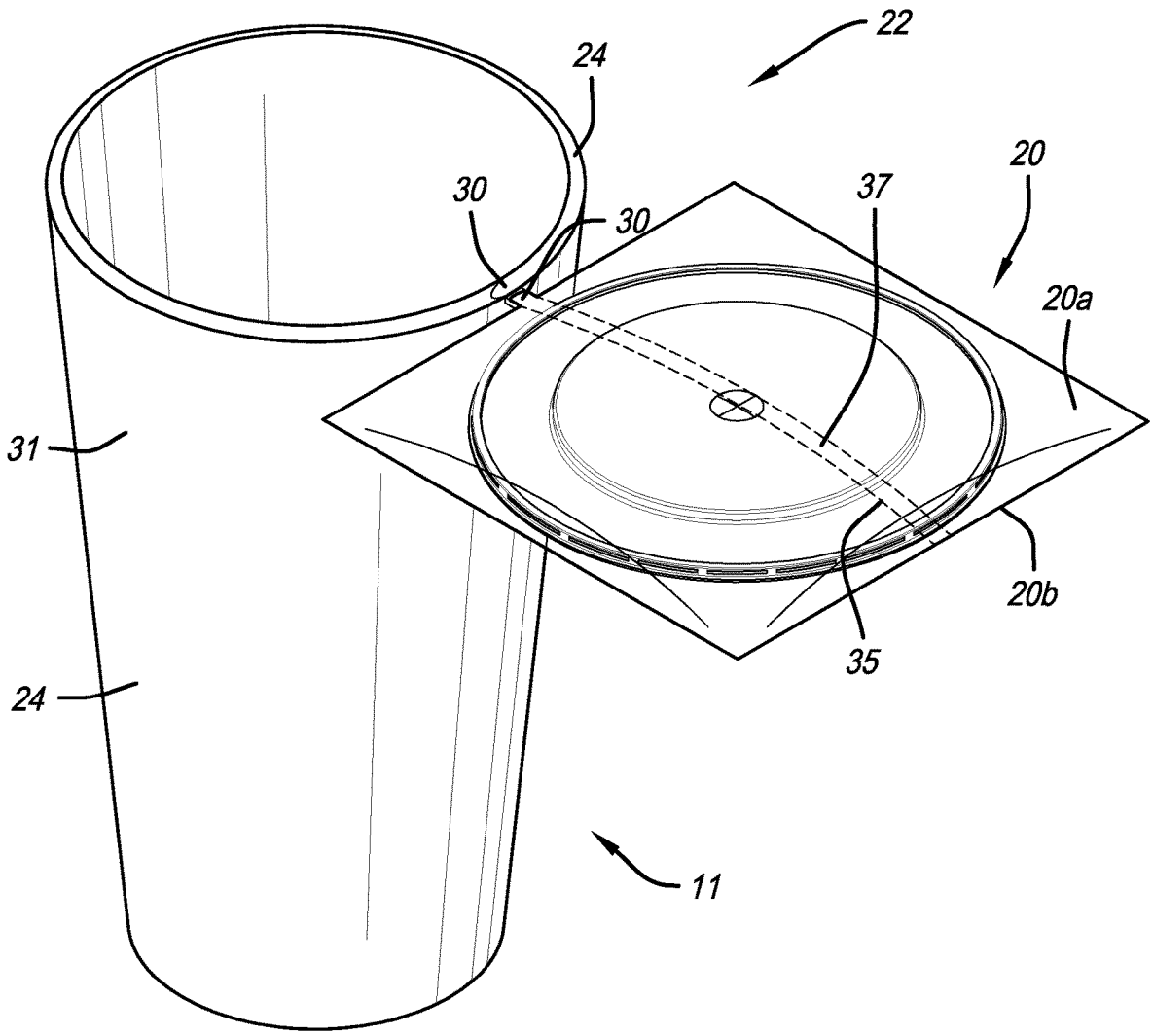
FIG. 16 is a perspective view of a cup and lid assembly with the lid in a lid cover that covers the top and bottom and includes a tear portion or weakened section.
Figure 18:
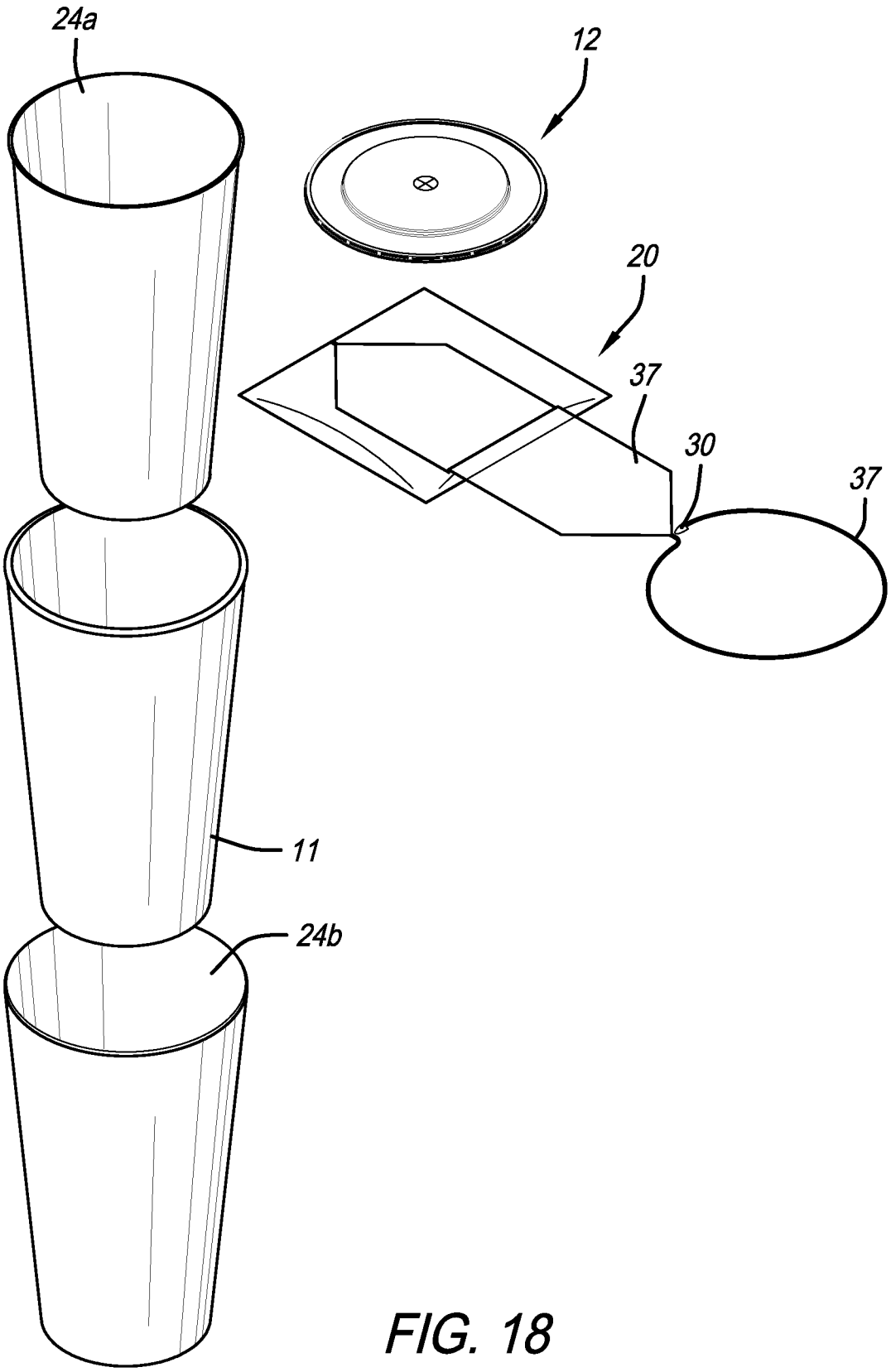
FIG. 18 is an exploded perspective view of the cup and lid assembly of FIG. 16 after the cup and lid have been removed from the seal assembly.

FIGS. 16-18 show embodiment of container and lid assemblies where one or both of all or the majority of the cup 11 and lid 12 are covered, enveloped or surrounded by a seal (e.g. lip or lid cover) or the like. FIG. 16 shows an embodiment where the lid cover 20 envelops the lid 12. In this embodiment, the lid cover 20 is a bag or chamber that envelops or surrounds the lid 12. This protects the bottom side or bottom surface of the lid and skirt and where it is attached to the lip of the cup. In this embodiment, the lid cover 20 or bag can include some type of tear strip or tear portion 37 or the like to allow a user to easily open and have access to the lid 12. In another embodiment, the inner surfaces of the upper and lower panels 20*a* and 20*b* or portions of the lid cover 20 can be adhered together (or at least a portion of the inner surfaces are adhered together) and they can be separated by pulling on a tab or a loose portion of the upper or lower panel and separating the panels to remove the lid (similar to a string cheese package or a lollipop package). This type of connection is also referred to herein as a "weakened section" because the connection between to the two panels or pieces is weak enough that pulling them apart will separate the two. The lid cover 20 can include an opening through which the connection member extends. In another embodiment, the lid cover 20 only covers or is attached to the bottom surface of the lid.

In a preferred embodiment, almost all or all of the cup 11 and lid 12 can be covered by the seal assembly 22, as shown in FIGS. 17-18. In FIG. 17, the lip cover 24 (or cup cover) covers the entire inside and outside of the cup and includes a tear portion 37 that extends circumferentially around the lip 16. The lid cover 20 is also a bag or envelope that includes the lid 12 therein. FIG. 18 shows the seal assembly 22 disassembled and removed (and exploded) from the cup and lid. In use, the user pulls the tab 30 and breaks or rips the tear portion around the lip, thus separating the inner and outer portions of the lip or cup cover (labeled 24*a* and 24*b* in FIGS. 17-18). The end of the tear portion 37 (the end opposite the pull tab) is connected to the connection member 26. As a result, the user can continue to pull the original tab 30 or can grab the connection member and tear the tear portion 37 on the lid cover 20 to open the bag and remove the lid 12. The tear portion or weakened lines and/or lid cover/bag can be any shape. Furthermore, the connecting portion 26 can be wider than is shown in FIG. 17. The connecting portion can be the tear portion or can include a tear portion extending therethrough. In another embodiment, the tab can be on the inner portion 24*a* of the lip member (similar to the inside tab in FIG. 6) and can be in line with the connecting member. The weakened section can be connected to the connection member 26. In use, pulling the tab fractures the lip cover and then pulls the connection member, which pulls on the lid cover to fracture and/or remove the lid cover. In another embodiment, the adhesive embodiment can be combined with the weakened section, tear member/portion. The tear portion or member can be used to tear an opening in the seal and then the remainder can be peeled off.

Figure 19:
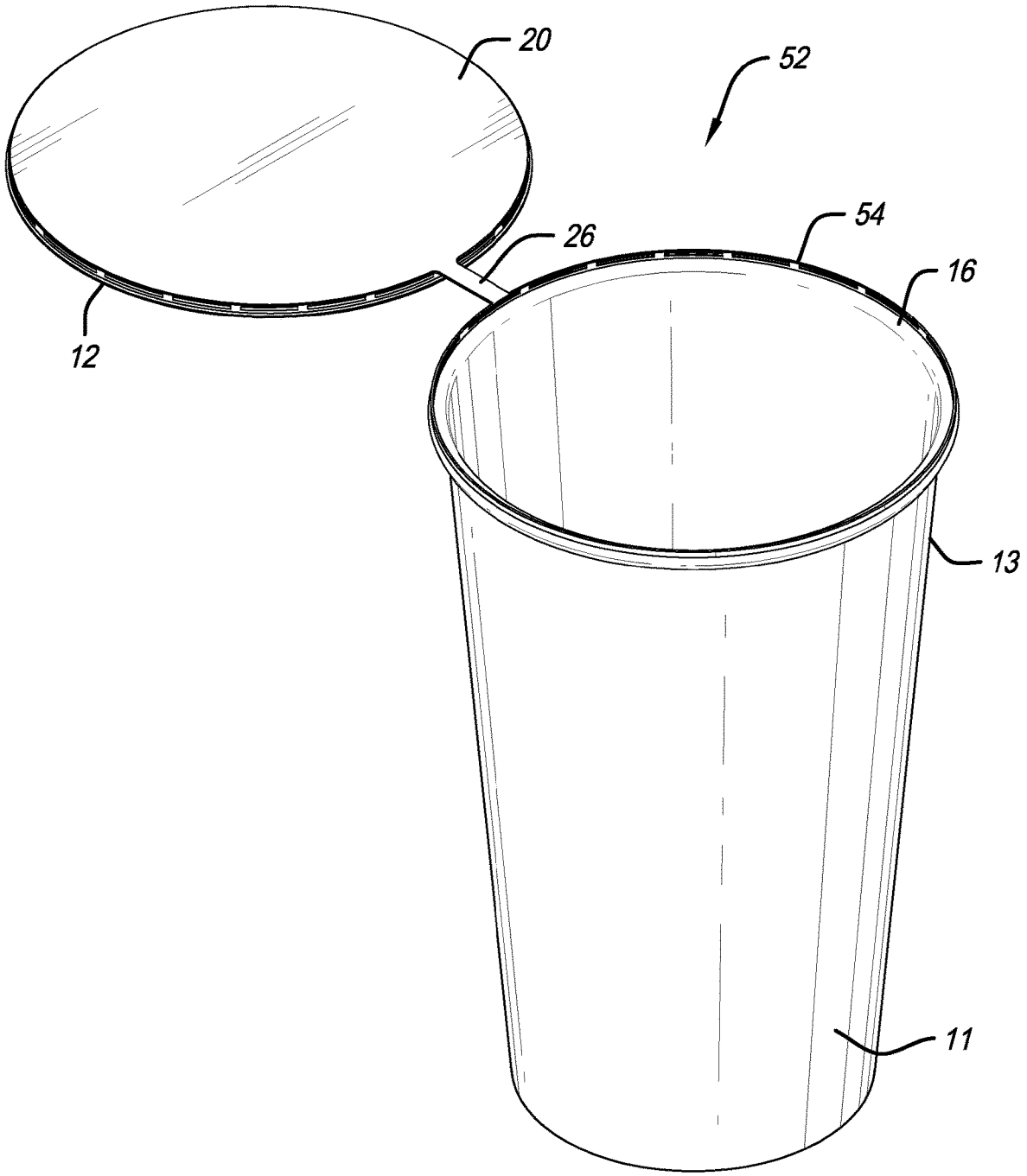
FIG. 19 is a perspective view of a cup and lid assembly wherein the lid cover is snap fit onto the lip of the cup from the bottom in accordance with a preferred embodiment of the present invention.

FIGS. 19-26 show further embodiments of the invention where a seal assembly 52 is secured on the cup 11. As shown in FIG. 19, seal assembly 52 includes a lid 12 with lid cover 20 thereon (the lid 12 and lid cover 20 together may be referred to herein as a lid assembly) and a lip cover 54. The lid assembly and lip cover 54 are connected by a connection member 26. The lip cover 54 is formed such that it can be secured on the lip 16 of the cup 11. In other words, the lip cover 54 is snap fit on the top of a cup 11 in the same or a similar manner as is the lid 12. The lip cover 54 includes a channel 56 that receives the lip 16 of the cup 11. As shown in FIG. 19, in a preferred embodiment, the connection member 26 is connected at one end to the lip cover 54 and at its opposite end to the lid cover 20. The lid cover 20 can be on the top of the lid, bottom of the lid or cover all or any portion of the lid, as described elsewhere herein. For example, this embodiment can be used where sanitization of the lip of the cup is not necessary or desired. However, this is not a limitation. The lip cover can also be a band or hoop that extends around the outside of the cup, adjacent to the top or lip of the cup. In other words, the lip cover does not necessarily have to cover the lip to serve the purposes of allowing the connection member to extend to the lid cover so that the lid assembly can be connected to the cup. In the situation where the lip cover does not cover the lip it may be referred to as a band. For purposes of the claims, the term lip cover covers a band that is extends around the outside of the cup and does not cover the lip. It may be referred to as a cup seal.

Figure 20:
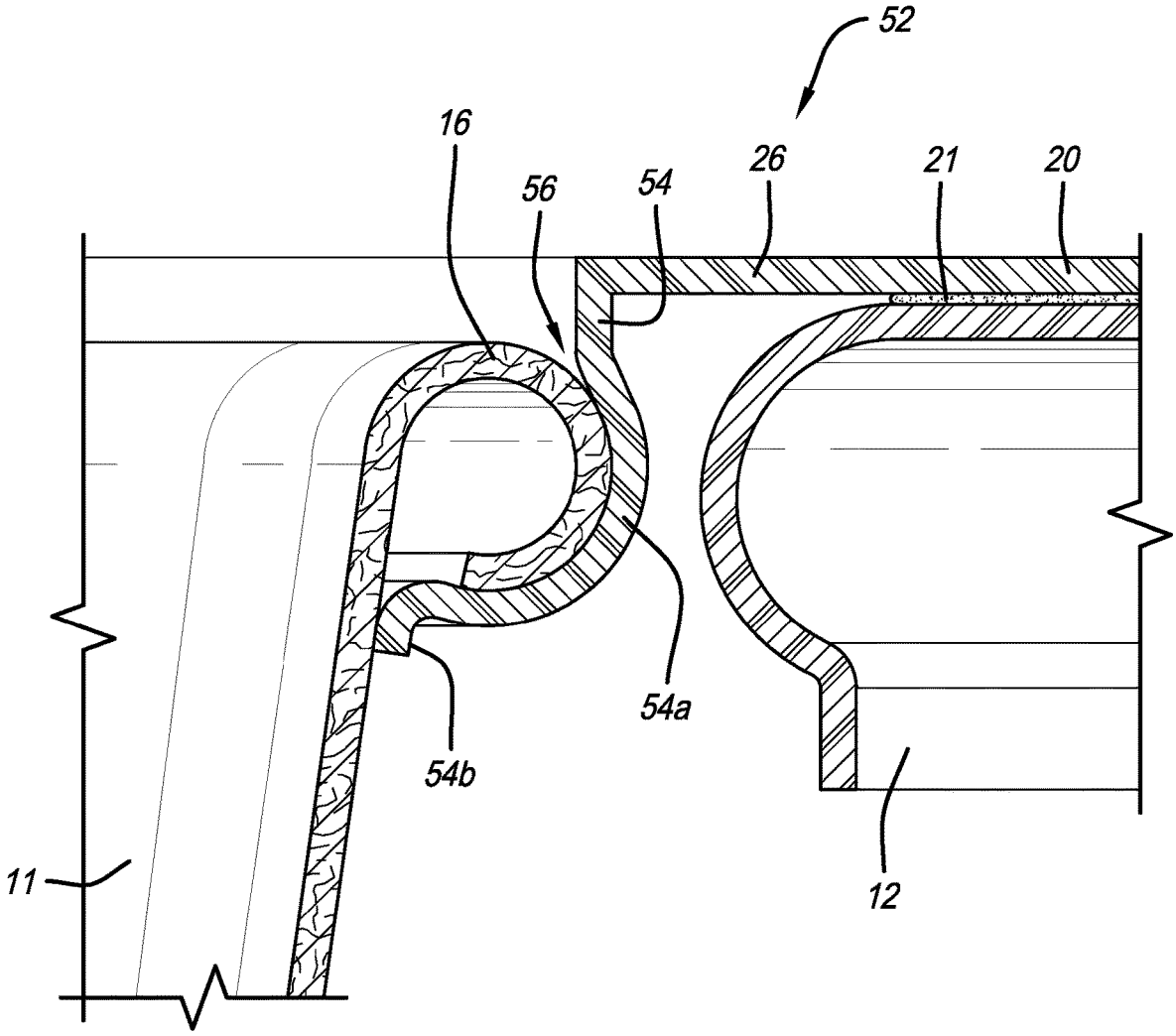
FIG. 20 is a cross-sectional view showing a portion of the cup and lid assembly of FIG. 19.
Figure 21:
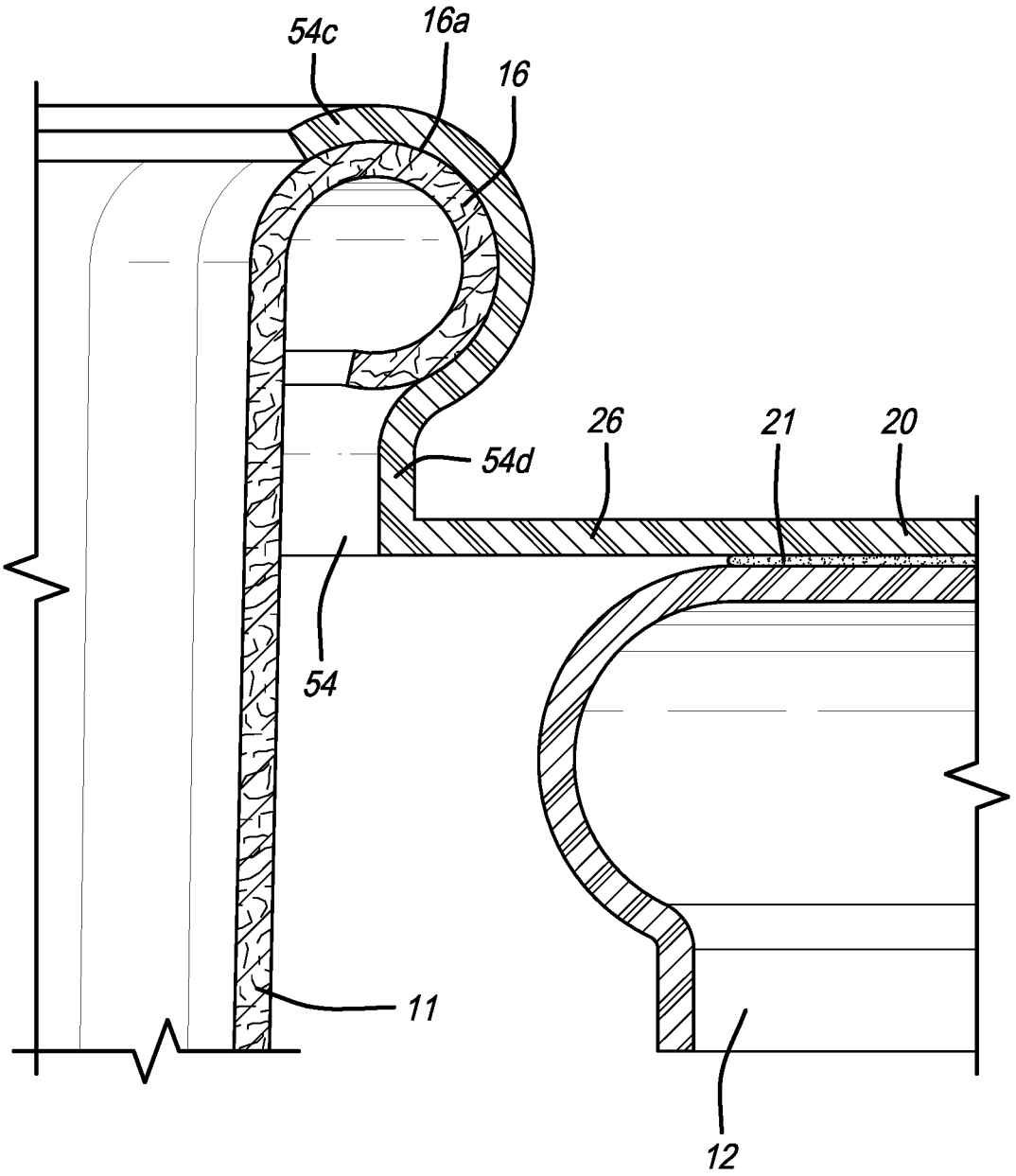
FIG. 21 is a cross-sectional view of a cup and lid assembly wherein the lid cover is snap fit onto the lip of the cup from the top.

FIG. 20 shows a preferred embodiment where the lip cover 54 is snap fit onto the cup 11 from the bottom. This works particularly well with paper or plastic cups that have a rolled lip 16. FIG. 21 shows another preferred embodiment where the lip cover 54 is snap fit onto the cup 11 from the top. In the embodiment shown in FIG. 20, the lip cover 54 includes an upper portion 54*a* that has a greater circumference than a lower portion 54*b*. The upper and lower portions 54*a* and 54*b* partially define the channel 56. The upper portion 54*a* fits snugly on the lip 16 and the lower portion 54*b* fits snugly against the outer surface of the cup. To put the seal assembly 52 on the cup 11, the band is slid up the cup 11 from the bottom and the upper portion 54*a* is snap fit onto the bottom of the lip 16 such that the lip 16 is received in channel 56. In the embodiment shown in FIG. 21 (wherein the band is snap fit onto the lip from the top of the cup), the lip cover 54 includes an upper portion 54*c* that contacts the top of the lip 16 and a lower portion or downwardly depending skirt 54*d*. Both the FIGS. 20 and 21 embodiments include the channel 56 for receiving or snap fitting on the lip 16.

In a preferred embodiment, the lip cover 54 is disposable. In use, the cups 11 come in a stack with the seal assembly 52 secured to the lip 16 of the cups 11. The lid 12 extends outwardly, as shown in FIG. 19, so that the cups 11 can all fit in one another in a nested fashion. After the cup and lid assembly is removed from the stack, the lip cover 54 is removed from cup, the lid cover is removed from the lid and the lid is placed on the cup.

Figure 22:
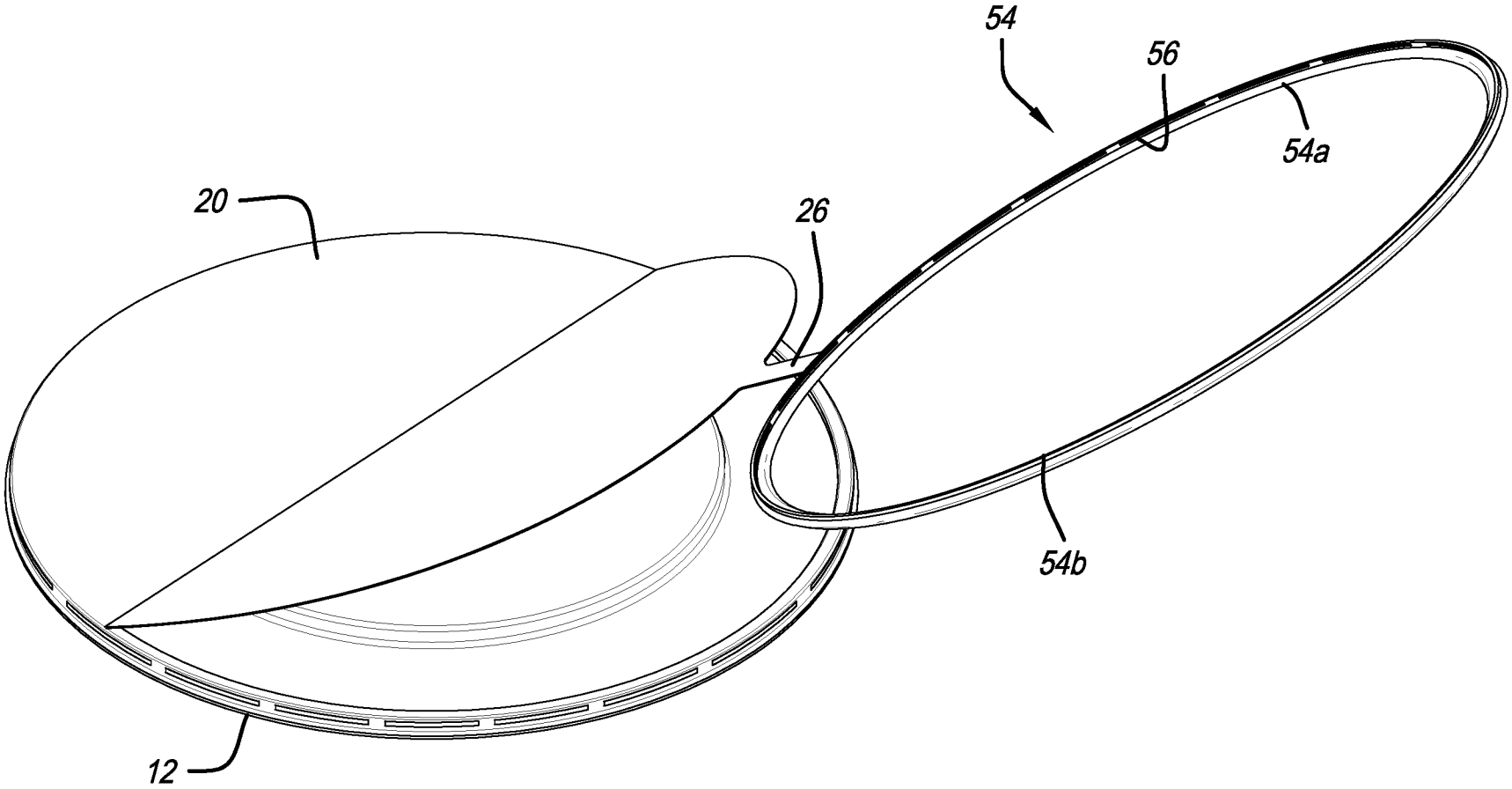
FIG. 22 is a perspective view of the seal assembly of FIG. 21 showing the lid cover partially removed.

In the embodiments shown in FIGS. 19-21, the lip cover 54, connection member 26 and lid cover 20 are unitary. Therefore, in use, as shown in FIG. 22, after the seal assembly is removed from the cup, the band can be pulled upwardly (or the connection member 26 can be grabbed) to peel the lid cover 20 off of the lid 12. In another embodiment, the connection member can be connected to a tear strip or tear portion that is part of the lid cover or seal (as shown in FIG. 18). Therefore, when the connection member is pulled upwardly, the tear strip exposes the lid and allows removal of the lid cover. In an alternative embodiment, the lid cover 20, lip cover 54 and connection member 26 are formed of separate pieces that are attached to one another.

In the embodiment shown in FIG. 20, the lip cover 54 extends high enough above the top of cup 11 that a user can push the lip cover 54 downwardly thereby separating the lip 16 from the channel 56 and causing the band to drop downwardly for disposal thereof. In the embodiment shown in FIG. 21, the user uses their fingers to pull upwardly on the skirt 54*d*, just as they would a typical lid, to remove the lip cover 54 from the cup 11. In both embodiments, the lid cover is then removed. After disposal of the lip cover 54 and the lid cover, the user fills the cup 11 and places the lid 12 on the top 15 thereof.

Furthermore, the lid 12, lip cover 54, connection member 26, lid cover 20 and other components are preferably formed of thin wall flexible plastic materials thus enabling the lid 12 and connection member to be bent and flexed. The lid assembly can be connected to the connection member 26 so that it is oriented upwardly or downwardly with respect to the band and lid.

Figure 23:
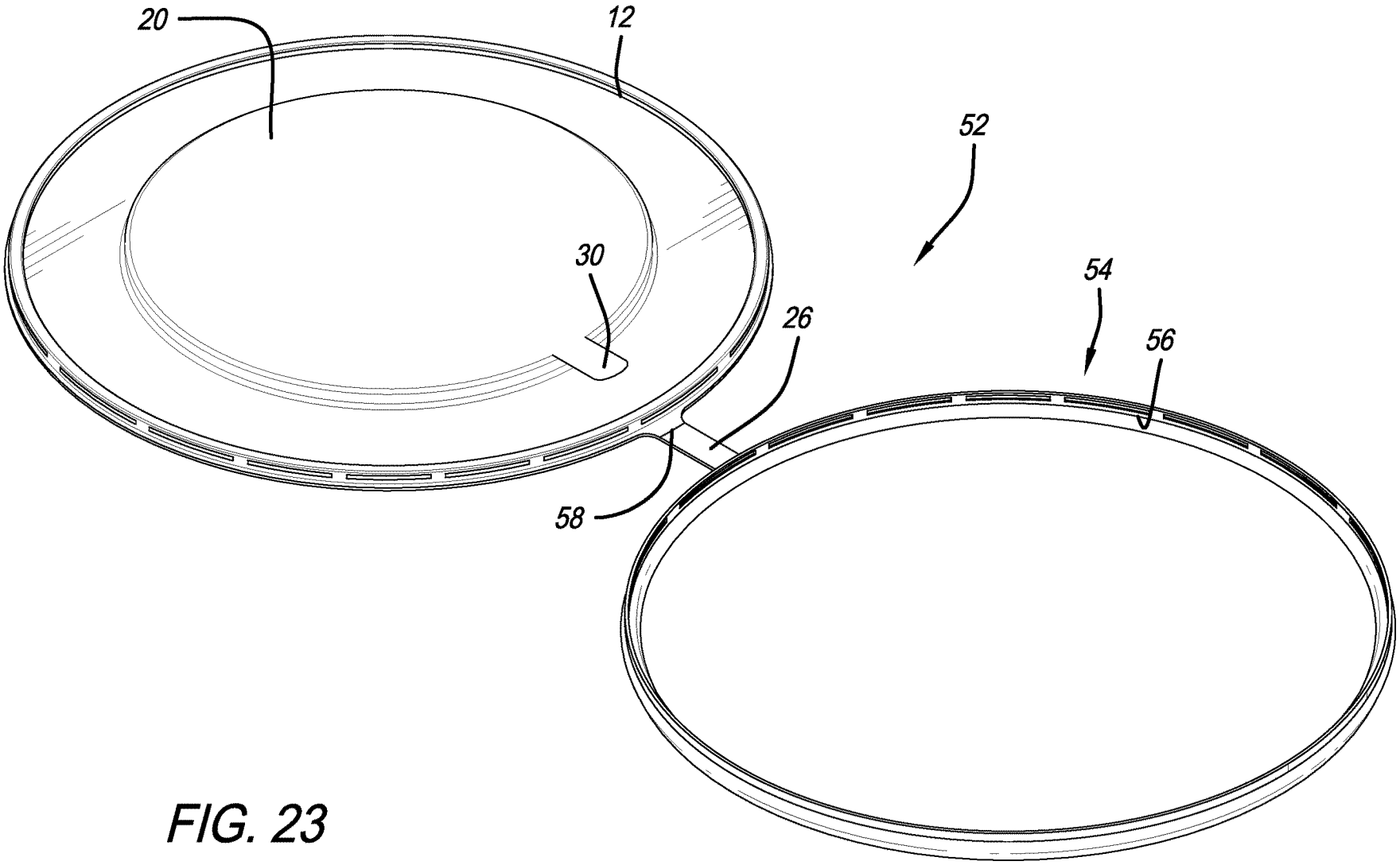
FIG. 23 is a perspective view of a seal assembly.

As shown in FIG. 23, in another embodiment, the lid cover 20 includes a tab 30 for peeling the lid cover 20 off of the lid 12. In this embodiment, the connection member can be torn or broken. In use, a user pulls a cup 11 from the stack and then tears the connection member 26 (preferably along score marks 58), thereby separating the lid 12 from the lip cover 54. The lip cover 54 is then removed from the top of the cup 11 and can then be disposed of. This lid cover 20 is removed. The steps in any method described herein can be done in any order unless specifically mentioned otherwise.

Figure 24:
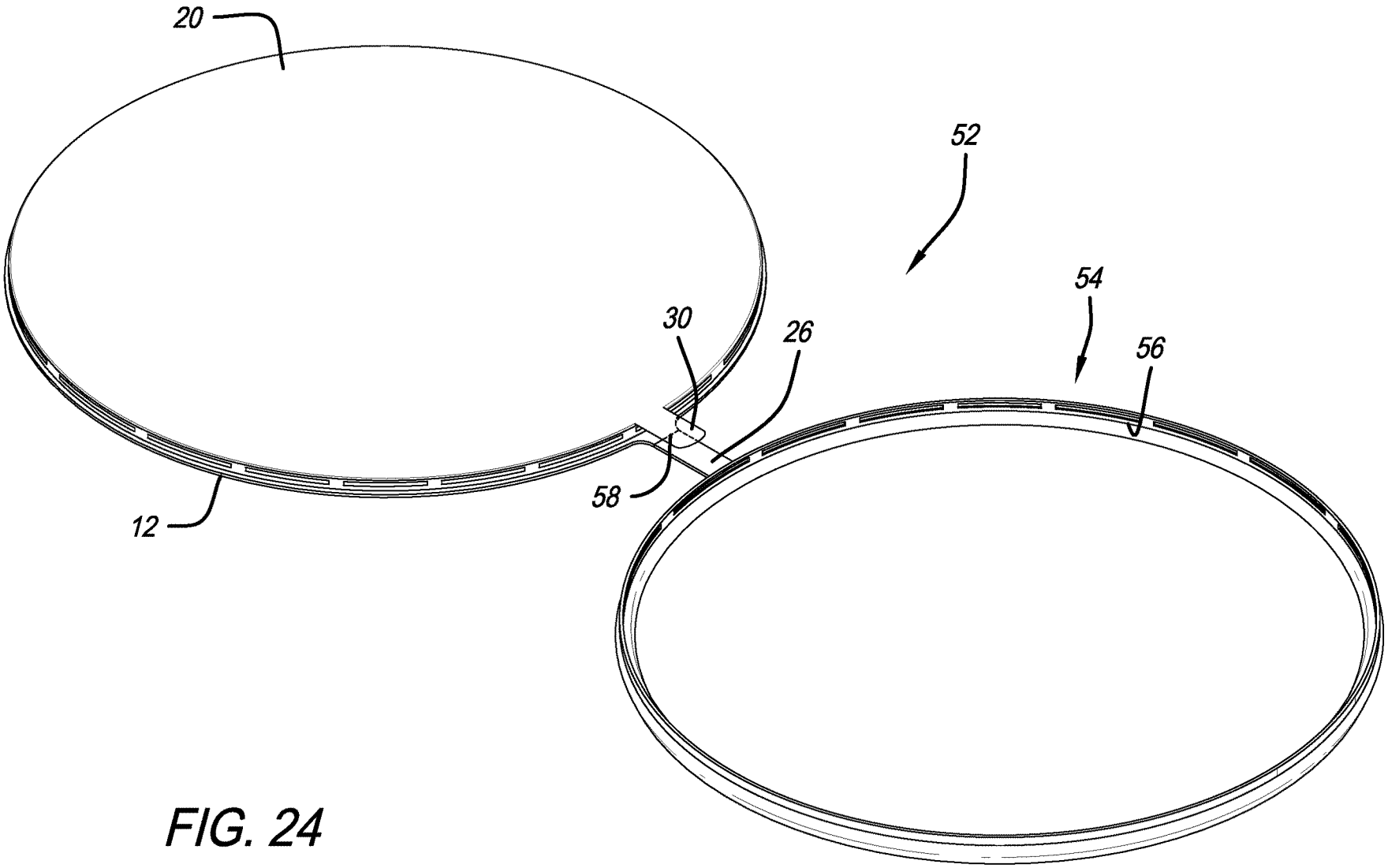
FIG. 24 is a perspective view of another seal assembly.

In FIG. 24, the tab 30 extends at least partially over or onto the connection member 26. In an embodiment, the connection member can be bent or pivoted at the score marks, weakened portion or pivot line to expose a portion of the tab 30. The user can then pull the tab to remove the lid cover 20, tear the connection member 26, remove the lip cover 54 and place the lid 12 on the cup 11.

Figure 25:
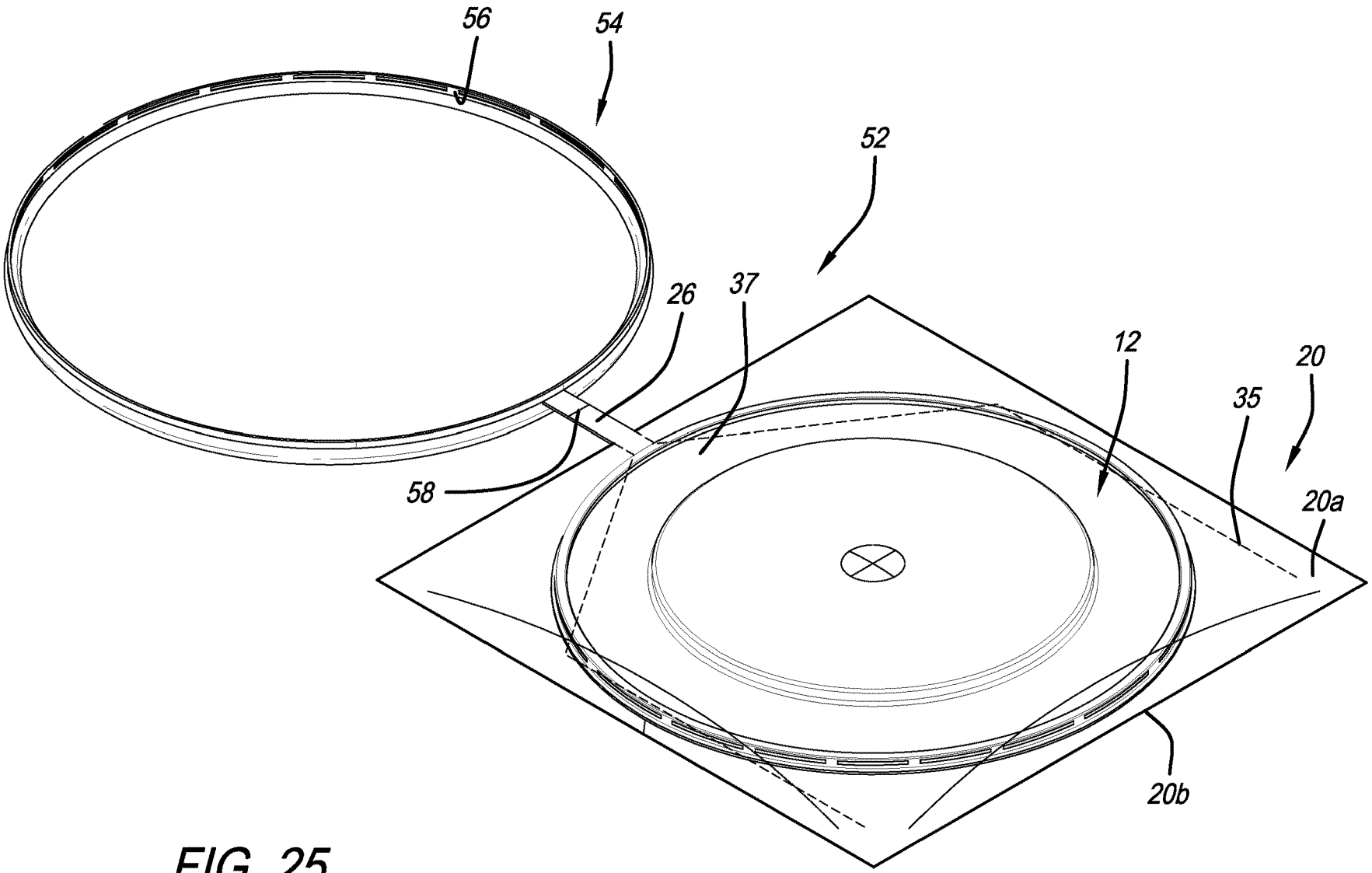
FIG. 25 is a perspective view of another seal assembly.
Figure 26:
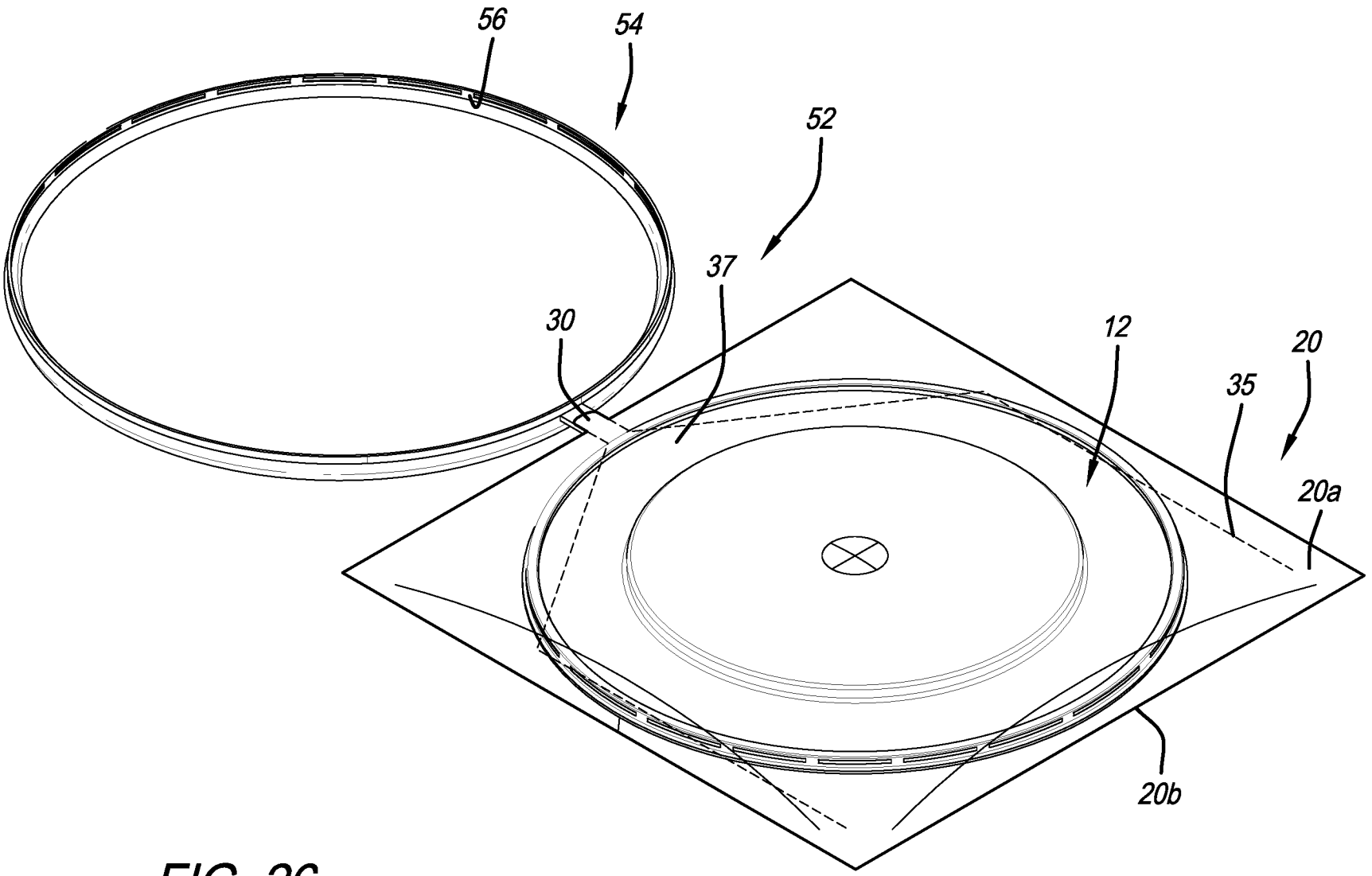
FIG. 26 is a perspective view of another seal assembly.

In FIGS. 25 and 26, the connection member 26 extends between the lip cover 54 and the lid cover 20, which covers the entire lid. In FIG. 25, the connection member is associated with or connected a weakened section (weakened lines 35 and tear portion 37). In this embodiment, the connection member 26 can be bent or pivoted at the score marks, weakened portion or pivot line to break the connection member. The user can then pull the tab created by the broken connection member to break the weakened section in the lid cover 20 that envelops the lid and remove the lip cover 54, remove the lid cover from the lid (or vice versa) and place the lid 12 on the cup 11. The user can also grasp and pull on the lip cover 54 to break the weakened section, without having to break the connection member 26 (similar to the action shown in FIG. 22). In FIG. 26, a separate tab 30 is included that is associated with or connected to the weakened section and can be pulled to tear open the lid cover 20. The steps described above can be done in another order. For example, the entire seal assembly can be separated from the cup first. It will be appreciated that the lid cover can include an extra tab, protrusion or portion for a person to grasp with one hand while pulling the tab 30, connection member 26 or lip cover 54 with the other hand to break the weakened section.

Figure 27:
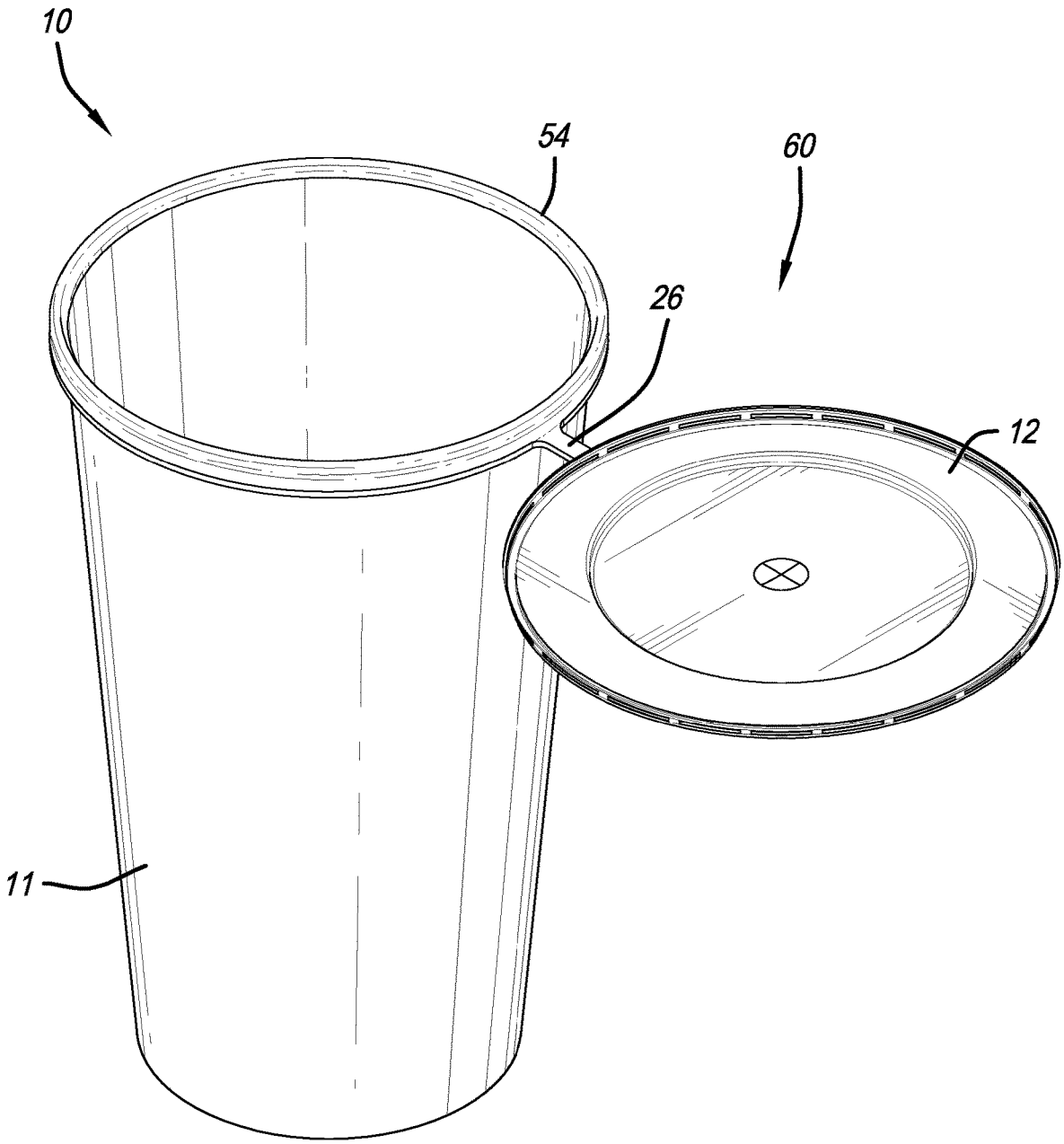
FIG. 27 is a perspective view of a cup and lid assembly where the lid is pivotable in accordance with a preferred embodiment of the invention.
Figure 28:
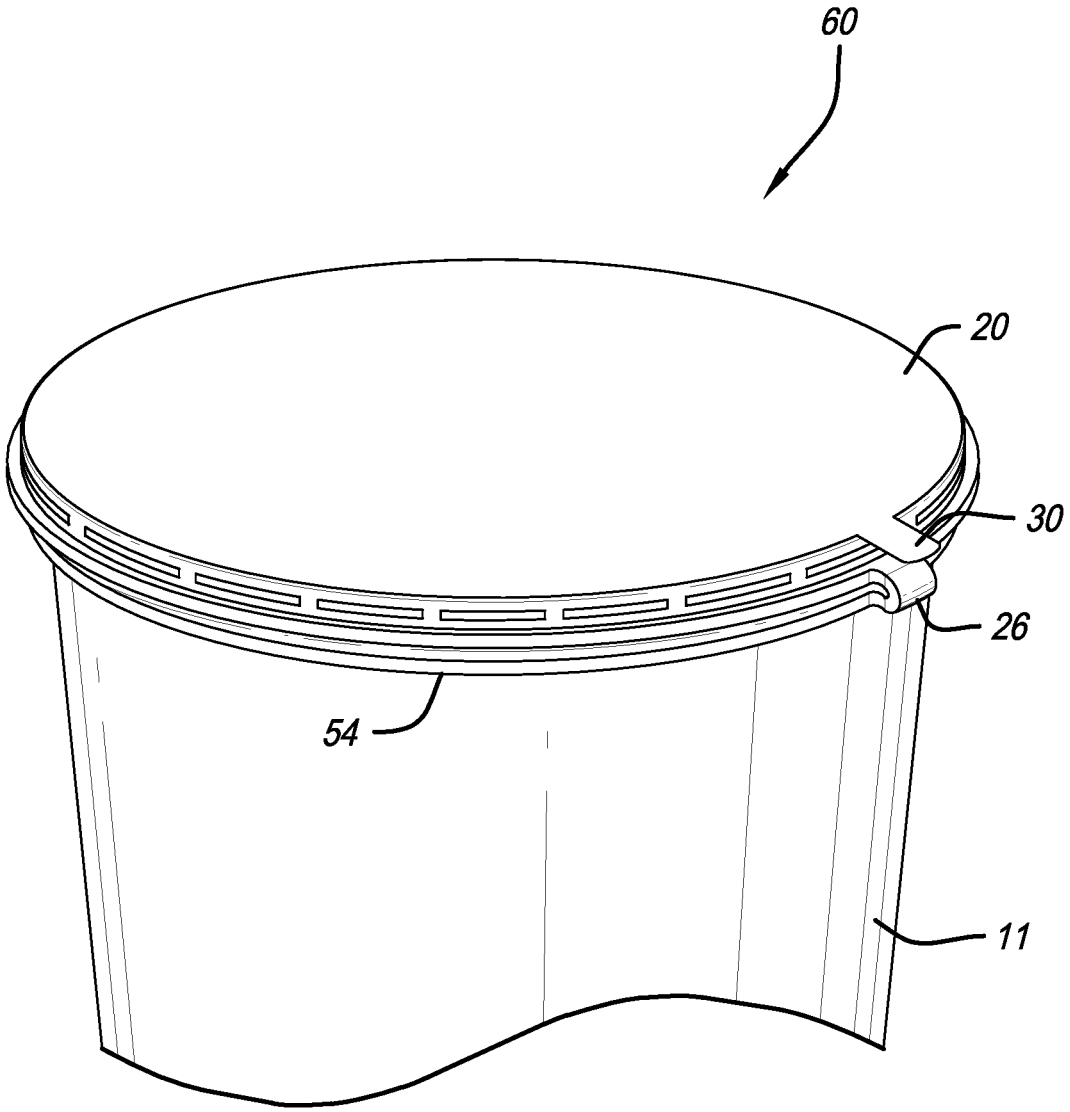
FIG. 28 is a perspective view of the cup and lid assembly of FIG. 27 showing the lid on the cup.
Figure 29:
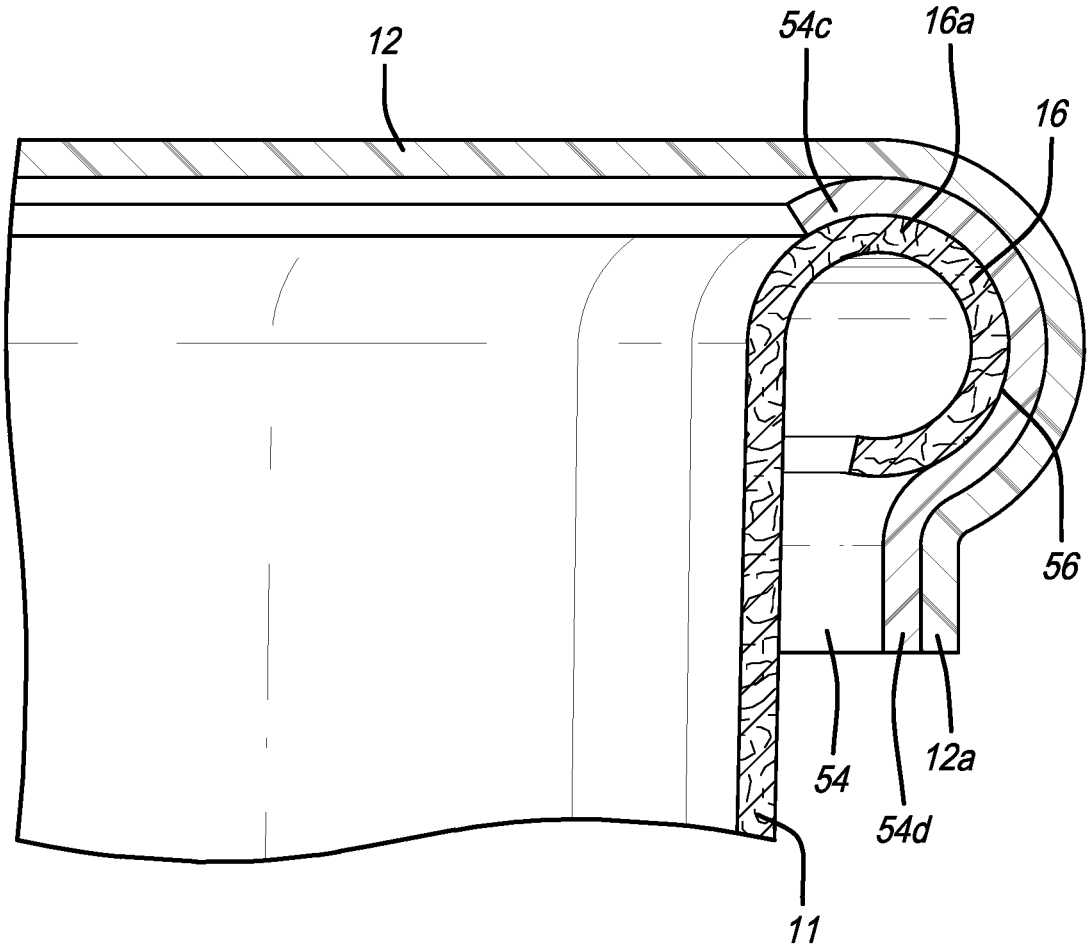
FIG. 29 is a cross-sectional view of the cup and lid assembly of FIG. 27 showing the lid on the cup.

FIGS. 27-29 show another embodiment of the invention wherein another seal assembly 60 is secured on the cup 11. Similar to the embodiment shown in FIGS. 19-26, seal assembly 60 includes a lid 12, lid cover, lip cover 54 and connection member 26. In this embodiment, the lid 12 (together with the lid cover 20) is pivotable at a point along the connection member 26 so that it can be fitted onto the cup 11. In the embodiment shown in FIGS. 27-29, the lip cover 54 fits onto the lip 16 from the top (as opposed to the bottom) so that the lid 12 can be secured over the lip cover 54 while the lip cover 54 is still secured on the lip 16. In another embodiment, the lip cover 54 can be positioned below the lip (on the sidewall) and the lid can be fitted directly onto the lip. It will be appreciated that in order for the pivoting to work, the lid 12 is secured to the connection member upside down.

As shown in FIG. 28, the lip 16 has a top surface 16*a*, and the upper portion 54*c* of the band contacts the top surface 16*a*. And, when on the cup, the inner surface of the lid 12 contacts the outer surface of the lip cover 54. Also, the lid 12 and the lip cover 54 each include a downwardly depending skirt 12*a* and 54*d*. The downwardly depending skirt 12*a* of the lid 12 contacts the downwardly depending skirt of the band when the lid 12 is secured on the band.

The lip cover 54 preferably includes a channel 56 that receives the lip 16 of the cup 11. However, this is not a limitation on the present invention. Channel 56 is similar to the channel on a typical plastic lid that is sold in convenient and fast food stores. When the lid 12 is placed on the lip cover 54, the channel on the lid 12 contacts or corresponds to the channel 56 on the band. As shown in the figures, the connection member 26 is connected at one end to the lip cover 54 and at its opposite end to the lid 12.

To secure the lip cover 54 on the lip 16, the lip cover 54 is pressed downwardly until it is snap fit onto the cup and the lip is received by the channel. This is similar to a typical lid being secured on the top of a cup in a convenient store and the like. Essentially, the lip cover 54 is a lid with the center removed so that another cup can fit therethrough and within be nested.

In a preferred embodiment, a lid member or seal can be placed over lip cover 54, to protect the drinking surface if a person decides to drink out of the cup (e.g., after finishing the majority of the drink using a straw, the user may remove the lid to drink the small amount remaining with the ice).

As shown in FIG. 27, in use, the lid 12 is pivoted and the lid 12 is placed over the lip cover 54 and snap fit onto the lip 16 of the cup 11. The lid cover 20 is then removed. In a preferred embodiment, the tab 30 extends at least partially over or along the connection member 26. This keeps the tab 30 "hidden" or aligned with the connection member when the seal assembly is in the stowed, extended or pre-use position. Then, after pivoting the lid and placing it on the cup, the tab 30 now extends outwardly, as shown in FIG. 26 so that it can be easily grasped and peeled off. In another embodiment, the entire lid is covered by or enveloped by the lid cover. In this embodiment, the lid cover includes upper and lower portions that are separated to release or expose the lid. For example, the tab can be on the upper portion of the lid cover and when it is pulled at least a portion of the upper and lower portions are separated from one another. In another embodiment, the lid cover can be connected to or unitary with the lip cover or cup cover as to allow nesting of cups, but that can be removed together.

Leaving the lip cover 54 on the cup in use prevents waste by having to discard the band. Preferably the lip cover 54 does not contact the inner surface of the cup. However, in another embodiment, a portion of the band can contact the inner surface of the cup, provided another cup can still nest in the cup. Generally, the bands and lip covers must be able to fit over the lips of each cup so that a plurality of cups can be stacked. Any orientation of the band and attached lid is within the scope of the present invention as long as the above goal is met.

In these embodiments, it is anticipated that the typical user will place the lid 12 over the lip cover 54 and onto the cup 11 and will use a straw to drink the liquid therein. In another embodiment, the band is secured tightly to the lip 16, e.g., by vacuum sealing or the like, so that a user could drink out of the cup without a lid and not have any of the liquid spill because of a loose fit between the band and the lip.

It should be understood that any and all embodiments disclosed, discussed or incorporated by reference herein and any components, items or portions thereof are interchangeable with any and all other embodiments disclosed or incorporated by reference herein.

Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A cup and lid assembly comprising:

a cup that includes at least one sidewall, a bottom, a lip and an open top, a lid, and a seal assembly that includes a lip cover, a lid cover, and a connection member extending between the lip cover and the lid cover, wherein the lip cover is secured on the cup and covers at least a portion of the lip, wherein the lid cover is secured on the lid, wherein the lip cover is separable from the lip, wherein the lid cover is separable from the lid, and wherein the lid is configured to be snap fit onto the lip of the cup after the lip cover is separated from the lip and the lid cover is separated from the lid.

2. The cup and lid assembly of claim 1 wherein the lip cover extends around the lip and defines a central opening, wherein the lip cover includes a tab that is configured to be pulled to remove the lip cover from the cup.

3. The cup and lid assembly of claim 2 wherein at least a first weakened section is formed in the lip cover adjacent to the tab, wherein the first weakened section is configured to be fractured when the tab is pulled.

4. The cup and lid assembly of claim 3 wherein the sidewall of the cup includes an inner surface and an outer surface, wherein the lip cover includes an inner portion that is positioned adjacent the inner surface of the cup and an outer portion that is positioned adjacent the outer surface of the cup, wherein the first weakened section extends around the lip of the cup, and wherein fracturing the first weakened section separates the inner and outer portions of the lip cover.

5. The cup and lid assembly of claim 4 wherein the first weakened section includes first and second opposite ends, wherein the first end is connected to the tab and the second end is connected to the connection member.

6. The cup and lid assembly of claim 5 wherein the connection member includes first and second opposite ends, wherein the first end is connected to the first weakened section, and wherein the second end is connected to a second weakened section defined in the lid cover.

7. A cup and lid assembly of claim 3 wherein the sidewall of the cup includes an inside surface and an outside surface, and wherein the tab is positioned adjacent one of the inside or outside surface.

8. The cup and lid assembly of claim 2 wherein the lip cover is temporarily adhered to the lip, and wherein pulling the tab peels at least a portion of the lip cover from the cup.

9. The cup and lid assembly of claim 1 wherein the lid cover is temporarily adhered to the lid.

10. The cup and lid assembly of claim 1 wherein the lid cover envelops the lid.

11. The cup and lid assembly of claim 1 wherein the lid cover includes a weakened section that when fractured allows removal of the lid cover from the lid.

12. The cup and lid assembly of claim 11 wherein the connection member includes first and second opposite ends, wherein the first end is connected to the lip cover and wherein the second end is connected to the weakened section.

13. The cup and lid assembly of claim 1 wherein the lid includes a top surface, wherein a drinking opening is defined through the lid, and wherein the lid cover covers at least a portion of the top surface and the drinking opening.

14. The cup and lid assembly of claim 1 wherein a sanitizing member is disposed between the lid cover and the lid, whereby after the lid cover is detached from the lid, the sanitizing member can be used to sanitize at least one of the lid or the cup.

15. The cup and lid assembly of claim 1 wherein the lip is a rolled lip.

16. The cup and lid assembly of claim 1 wherein the cup is a disposable or single-use cup.

17. A method of putting a lid on a cup that includes at least one sidewall, a bottom, a lip and an open top, wherein the lid and cup are part of a cup and lid assembly that includes a seal assembly that includes a lid cover that is secured over at least a portion of the top surface of the lid, a lip cover that is secured over at least a portion of the lip and a connection member that extends between the lip cover and the lid cover, the method comprising the steps of:

(a) separating the lid cover from the lid, (b) separating the lip cover from the lip, and (c) securing the lid on the lip of the cup.

18. The method of claim 17 wherein the lip cover extends around the lip and defines a central opening, wherein the lip cover includes a tab, and wherein the method includes pulling the tab to remove the lip cover from the cup.

19. The method of claim 18 wherein the method includes pulling the tab to remove both the lip cover from the lip and the lid cover from the lid.

20. The method of claim 18 wherein at least a first weakened section is formed in the lip cover adjacent to the tab, and wherein the method includes fracturing the first weakened section when the tab is pulled.

21. A method of putting a lid on a container that includes at least one sidewall, a bottom, a lip and an open top, the method comprising the steps of:

(a) removing a seal assembly from the container, wherein the seal assembly includes a lid cover that is secured over at least a portion of the lid, wherein the seal assembly includes a lip cover that is secured to the lip of the container and a connection member that extends between the lip cover and the lid cover, wherein the lip cover extends around the lip and defines a central opening, wherein the lip cover includes a tab, wherein at least a first weakened section is formed in the lip cover adjacent to the tab, wherein the first weakened section includes first and second opposite ends, wherein the first end is connected to the tab and the second end is connected to the connection member, wherein the connection member includes first and second opposite ends, wherein the first end is connected to the first weakened section and wherein the second end is connected to a second weakened section defined in the lid cover, (b) pulling the tab to fracture the first and second weakened sections, (c) removing the lid cover from the lid, and (d) placing the lid on the container.

22. The method of claim 17 wherein the lid cover includes a tab, and wherein the method includes pulling the tab to remove the lid cover from the lid.

23. The method of claim 17 wherein the lip is a rolled lip and where the lid is snap fit on the rolled lip.

24. The method of claim 17 wherein the lid includes a top surface that includes a drinking opening, and wherein the lid cover covers at least a portion of the top surface and the drinking opening, and wherein step (a) includes separating the lid cover from the lid to reveal the drinking opening.

25. The method of claim 24 wherein the lip includes a top surface that defines a drinking surface, and wherein step (b) includes separating the lip cover from the lip to reveal the drinking surface.

* * * * *